US009758979B2

(12) United States Patent
Rief et al.

(10) Patent No.: US 9,758,979 B2
(45) Date of Patent: Sep. 12, 2017

(54) SWIMMING POOL CLEANER

(71) Applicant: Hayward Industries, Inc., Elizabeth, NJ (US)

(72) Inventors: Dieter J. Rief, Santa Rosa, CA (US); Hans Rainer Schlitzer, Rohnert Park, CA (US)

(73) Assignee: Hayward Industries, Inc., Elizabeth, NJ (US)

( * ) Notice: Subject to any disclaimer, the term of this patent is extended or adjusted under 35 U.S.C. 154(b) by 137 days.

(21) Appl. No.: 14/489,259

(22) Filed: Sep. 17, 2014

(65) Prior Publication Data

US 2015/0020368 A1 Jan. 22, 2015

Related U.S. Application Data

(60) Division of application No. 13/627,637, filed on Sep. 26, 2012, now Pat. No. 9,593,502, which is a (Continued)

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01); *Y10T 29/49863* (2015.01)

(58) Field of Classification Search
CPC ..... E04H 4/16; E04H 4/1654; E04H 4/1636
(Continued)

(56) References Cited

U.S. PATENT DOCUMENTS 2,191,424 A 2/1940 Cardinal
2,283,835 A 5/1942 Weaver
(Continued)

FOREIGN PATENT DOCUMENTS

AU 704603 B2 4/1999
DE 2612043 A1 9/1977
(Continued)

OTHER PUBLICATIONS

Office Action dated Jul. 27, 2016, issued in connection with U.S. Appl. No. 14/489,240 (7 pages).
(Continued)

*Primary Examiner* — Michael Jennings
(74) *Attorney, Agent, or Firm* — McCarter & English, LLP

(57) ABSTRACT

A swimming pool cleaner including a body having a debris inlet and a debris outlet and defining an elongate slotted cavity pivotably holding proximal ends of flap members forming a segmented skirt which forms with the pool surface a plenum from which water and debris are drawn into the inlet. The slotted cavity is configured for strain-free insertion of the flap-member proximal ends into the cavity. A removable nozzle within the debris inlet and retaining the flap-member proximal ends in the cavity. A method for inlet to control debris-laden water flow. The cleaner further including a tool-free nozzle-mounting structure at the debris inlet removably retaining the nozzle within the debris inlet and a tool-free wheel-mounting assembly, a plurality of removable nozzles are interchangeably secured within the debris inlet, each nozzle having a flow opening sized differently from flow opening(s) of the other nozzle(s) to control debris-laden water flow.

6 Claims, 13 Drawing Sheets

Related U.S. Application Data continuation-in-part of application No. 12/581,405, filed on Oct. 19, 2009, now Pat. No. 8,402,585.

(58) Field of Classification Search
USPC ..... 15/1.7
See application file for complete search history.

(56) References Cited

U.S. PATENT DOCUMENTS

D144,063 S 3/1946 McAllister
D175,210 S 7/1955 Dreyfuss
D176,635 S 1/1956 Shalvoy
D186,872 S 12/1959 Swann
2,977,613 A * 4/1961 Mikulas ..... E04H 4/16 15/1.7
3,019,462 A 2/1962 Nash et al.
3,039,122 A 6/1962 Birdsall
3,186,550 A 6/1965 Beduhn
3,310,173 A 3/1967 Sosower
3,321,787 A 5/1967 Myers
3,324,492 A 6/1967 Myers
3,439,368 A 4/1969 Myers
RE26,741 E 12/1969 Myers
3,551,930 A 1/1971 Myers
3,650,407 A 3/1972 Benham, Jr.
3,665,942 A 5/1972 Moore
3,676,885 A 7/1972 Wulc
3,689,408 A 9/1972 Edmiston et al.
3,767,055 A 10/1973 Flatland
3,794,052 A 2/1974 Koble, Jr. et al.
3,797,508 A 3/1974 Jacobs
3,803,658 A 4/1974 Raubenheimer
3,805,815 A 4/1974 Goodin
3,822,754 A 7/1974 Henkin et al.
3,868,739 A 3/1975 Hargrave
3,886,616 A 6/1975 Hayes
3,921,654 A 11/1975 Pansini
3,936,899 A 2/1976 Henkin et al.
3,959,838 A 6/1976 Hannah
3,972,339 A 8/1976 Henkin et al.
3,979,788 A 9/1976 Strausak
4,023,227 A 5/1977 Chauvier
4,049,126 A 9/1977 Halverson
4,100,641 A 7/1978 Pansini
4,133,068 A 1/1979 Hofmann
4,152,802 A 5/1979 Chauvier
4,154,680 A 5/1979 Sommer
4,156,948 A 6/1979 Chauvier et al.
4,168,557 A 9/1979 Rasch et al.
4,193,156 A 3/1980 Chauvier
4,208,752 A 6/1980 Hofmann
D259,313 S 5/1981 Nordlund
D259,314 S 5/1981 Nordlund
4,281,995 A 8/1981 Pansini
D260,830 S 9/1981 Trouba
4,299,051 A 11/1981 Pauly et al.
4,306,329 A 12/1981 Yokoi
4,338,697 A 7/1982 Broadwater
4,351,077 A 9/1982 Hofmann
4,402,101 A 9/1983 van Zyl
4,429,429 A 2/1984 Altschul
4,431,538 A 2/1984 Selsted
4,434,519 A 3/1984 Raubenheimer
4,449,265 A 5/1984 Hoy
D279,227 S 6/1985 Price
4,536,908 A 8/1985 Raubenheimer
4,558,479 A 12/1985 Greskovics et al.
4,575,423 A 3/1986 Alanis et al.
4,583,647 A 4/1986 Schinzing
4,589,986 A 5/1986 Greskovics et al.
4,651,376 A 3/1987 Ford
4,652,366 A 3/1987 Brooks
4,656,683 A 4/1987 Raubenheimer
4,692,956 A 9/1987 Kassis
4,761,848 A 8/1988 Hofmann
4,768,532 A 9/1988 Johnson
4,769,867 A 9/1988 Stoltz
4,776,954 A 10/1988 Brooks
4,778,599 A 10/1988 Brooks
4,807,318 A 2/1989 Kallenbach
4,839,063 A 6/1989 Brooks
4,849,024 A 7/1989 Supra
D304,505 S 11/1989 Maier et al.
4,884,392 A 12/1989 Czajkowski et al.
4,920,599 A 5/1990 Rief
4,923,202 A 5/1990 Breveglieri et al.
4,950,393 A 8/1990 Goettl
4,959,146 A 9/1990 Kristan
4,962,559 A 10/1990 Schuman
D315,624 S 3/1991 Kimura et al.
5,001,800 A 3/1991 Parenti et al.
5,014,382 A 5/1991 Kallenbach
5,033,148 A 7/1991 Chauvier et al.
5,044,034 A 9/1991 Iannucci
5,093,950 A 3/1992 Heier
5,097,559 A 3/1992 Brunt et al.
5,099,535 A 3/1992 Chauvier et al.
D325,452 S 4/1992 Gefter
D325,488 S 4/1992 Sheriff
D325,796 S 4/1992 Kallenbach
5,105,496 A 4/1992 Gray, Jr. et al.
5,172,445 A 12/1992 Chandler
5,197,158 A 3/1993 Moini
5,223,135 A 6/1993 MacPhee et al.
5,226,205 A 7/1993 Pearce
5,245,723 A 9/1993 Sommer
5,265,297 A 11/1993 Gould et al.
5,293,659 A 3/1994 Rief et al.
D346,888 S 5/1994 Stone
5,337,434 A 8/1994 Erlich
5,351,355 A 10/1994 Chiniara
5,375,726 A 12/1994 Lechleiter
5,412,826 A 5/1995 Raubenheimer
5,435,031 A 7/1995 Minami et al.
D361,178 S 8/1995 Piret
5,450,644 A 9/1995 Berman
5,450,645 A 9/1995 Atkins
5,454,129 A 10/1995 Kell
5,485,931 A 1/1996 Barr, Jr.
5,507,058 A 4/1996 Minami et al.
5,507,068 A 4/1996 Fan et al.
D372,827 S 8/1996 Roche et al.
D373,230 S 8/1996 Sebor et al.
5,546,982 A 8/1996 Clark et al.
5,569,371 A 10/1996 Perling
D375,592 S 11/1996 Ljunggren
D376,450 S 12/1996 Campbell et al.
D377,310 S 1/1997 Crump, Jr.
5,603,135 A 2/1997 Jones et al.
5,604,950 A 2/1997 Stern
5,615,782 A 4/1997 Choe
5,617,600 A 4/1997 Frattini et al.
5,634,229 A 6/1997 Stoltz
D384,782 S 10/1997 Gefter
5,678,700 A 10/1997 Crosson, Jr.
5,720,068 A 2/1998 Clark et al.
5,737,791 A 4/1998 Durigon
D394,775 S 6/1998 Anderson et al.
5,794,293 A 8/1998 Hoffinger
5,794,799 A 8/1998 Collins et al.
5,797,156 A 8/1998 Sebor
5,802,653 A 9/1998 Roumagnac
D400,319 S 10/1998 Hofheins et al.
5,842,243 A 12/1998 Horvath et al.
5,882,512 A 3/1999 Denkewicz, Jr. et al.
D408,104 S 4/1999 Adam
5,893,188 A 4/1999 Campbell et al.
5,896,610 A 4/1999 Sebor et al.
5,930,856 A 8/1999 Van Der Meyden et al.
5,933,899 A 8/1999 Campbell et al.
5,935,179 A 8/1999 Kleiner et al.
5,961,822 A 10/1999 Polimeni, Jr.
5,970,557 A 10/1999 Supra
D417,047 S 11/1999 Tsuda

(56) References Cited

U.S. PATENT DOCUMENTS

D417,322 S 11/1999 Hollinger
5,985,156 A 11/1999 Henkin et al.
6,003,184 A 12/1999 Campbell et al.
D418,640 S 1/2000 Veloskey et al.
6,013,178 A 1/2000 Strano et al.
D421,512 S 3/2000 Campbell
6,039,886 A 3/2000 Henkin et al.
6,049,933 A 4/2000 McLaughlin
6,089,383 A 7/2000 Heneveld
6,090,219 A 7/2000 Henkin et al.
D429,393 S 8/2000 Rief et al.
D430,368 S 8/2000 Porat et al.
6,094,764 A 8/2000 Veloskey et al.
6,099,658 A 8/2000 Porat
D430,960 S 9/2000 van der Meyden et al.
D430,962 S 9/2000 Porat et al.
6,112,354 A 9/2000 Stoltz et al.
6,115,864 A 9/2000 Davidsson et al.
6,119,293 A 9/2000 Phillipson et al.
6,125,492 A 10/2000 Prowse
6,131,227 A 10/2000 Rief et al.
D433,545 S 11/2000 Hollinger et al.
6,155,657 A 12/2000 Erlich et al.
D436,700 S 1/2001 Forbes et al.
6,199,237 B1 3/2001 Budden
6,206,547 B1 3/2001 Erlich
6,212,725 B1 4/2001 Porat
D443,737 S 6/2001 Rief et al.
D444,280 S 6/2001 Rief et al.
D445,225 S 7/2001 Schaub
6,280,611 B1 8/2001 Henkin et al.
6,292,970 B1 9/2001 Rief et al.
6,294,084 B1 9/2001 Henkin et al.
6,298,513 B1 10/2001 Rief et al.
6,299,699 B1 10/2001 Porat et al.
6,309,468 B1 10/2001 Sommer
6,311,353 B1 11/2001 Phillipson et al.
6,365,039 B1 4/2002 Henkin et al.
6,387,250 B1 5/2002 Henkin et al.
6,398,878 B1 6/2002 Henkin et al.
6,409,916 B1 6/2002 Zelas et al.
6,412,133 B1 7/2002 Erlich et al.
D463,889 S 10/2002 Buzzi
6,473,927 B1 11/2002 Sommer
6,473,928 B1 11/2002 Veloskey et al.
6,485,638 B2 11/2002 Henkin et al.
D469,589 S 1/2003 Wichmann et al.
6,502,269 B1 1/2003 Balchan et al.
D471,330 S 3/2003 Campbell
D474,312 S 5/2003 Stephens et al.
6,564,417 B2 5/2003 Porat
6,601,255 B1 8/2003 van der Meyden et al.
6,627,074 B2 9/2003 Lincke
6,652,742 B2 11/2003 Henkin et al.
6,665,900 B2 12/2003 Wichmann et al.
RE38,479 E 3/2004 Henkin et al.
6,706,175 B1 3/2004 Rief et al.
6,733,046 B1 5/2004 Rief
6,742,613 B2 6/2004 Erlich et al.
6,749,074 B1 6/2004 Hileman et al.
6,751,822 B2 6/2004 Phillipson et al.
6,752,278 B2 6/2004 Craft et al.
6,758,226 B2 7/2004 Porat
6,782,578 B1 8/2004 Rief et al.
6,802,963 B2 10/2004 Campbell
6,815,918 B2 11/2004 Porat et al.
6,842,931 B2 1/2005 Porat et al.
6,854,148 B1 2/2005 Rief et al.
6,886,205 B1 5/2005 Pichon
6,954,960 B2 10/2005 Pichon
6,965,814 B2 11/2005 Hadari
6,971,136 B2 12/2005 Horvath et al.
6,979,400 B2 12/2005 Bauckman et al.
7,039,980 B2 5/2006 Van Der Meyden et al.
D524,495 S 7/2006 Ljunggren
7,080,424 B2 7/2006 Kallenbach et al.
D526,101 S 8/2006 Blanc-Tailleur
7,089,876 B2 8/2006 Porat
7,103,449 B2 9/2006 Woo et al.
D529,669 S 10/2006 Blanc-Tailleur
7,117,554 B2 10/2006 Pichon
7,118,632 B2 10/2006 Sumonthee
7,118,678 B2 10/2006 Porat
7,143,502 B2 12/2006 Porat et al.
7,165,284 B2 1/2007 Erlich et al.
7,168,120 B2 1/2007 Habif et al.
D537,576 S 2/2007 Koury et al.
7,178,188 B1 2/2007 Jaakola
7,213,287 B2 5/2007 Hui
D550,906 S 9/2007 Fritz et al.
7,316,751 B2 1/2008 Horvath et al.
7,318,448 B2 1/2008 Fleischer et al.
7,395,571 B2 7/2008 Van Der Meijden et al.
D575,915 S 8/2008 Dreyer
7,501,056 B2 3/2009 Henkin et al.
7,506,770 B2 3/2009 Rief
7,515,991 B2 4/2009 Egawa et al.
D598,168 S 8/2009 Sumonthee
D599,967 S 9/2009 Blanc-Tailleur
7,614,425 B2 11/2009 Bauckman
7,661,381 B2 2/2010 Gorelik et al.
7,677,268 B2 3/2010 Griffin et al.
7,682,461 B2 3/2010 Sommer et al.
7,690,066 B2 4/2010 Stoltz et al.
7,723,934 B2 5/2010 Adam et al.
7,786,381 B2 8/2010 Henkin et al.
7,805,792 B2 10/2010 Roumagnac
7,827,643 B2 11/2010 Erlich et al.
D630,808 S 1/2011 Dye et al.
D630,809 S 1/2011 Dye et al.
7,867,389 B2 1/2011 Hui
7,900,308 B2 3/2011 Erlich et al.
7,908,696 B2 3/2011 Pareti
7,908,697 B2 3/2011 Lavabre et al.
7,987,542 B2 8/2011 Moore et al.
8,007,653 B2 8/2011 Porat
8,266,752 B2 9/2012 Henkin et al.
8,296,891 B1 10/2012 Rowam et al.
8,307,485 B2 11/2012 Sumonthee
8,343,339 B2 1/2013 Sumonthee
8,393,033 B2 3/2013 Pichon et al.
8,402,585 B2 3/2013 Rief et al.
8,434,182 B2 5/2013 Horvath et al.
8,709,243 B2 4/2014 Hui
8,784,652 B2 7/2014 Rief et al.
2002/0104790 A1 8/2002 Lincke
2002/0116772 A1 8/2002 Phillipson et al.
2003/0106174 A1 6/2003 Kallenbach et al.
2003/0177594 A1 9/2003 Van Der Meyden et al.
2003/0182742 A1 10/2003 Wichmann et al.
2004/0010867 A1 1/2004 Habif et al.
2004/0021439 A1 2/2004 Porat et al.
2004/0025268 A1 2/2004 Porat et al.
2004/0074524 A1 4/2004 Horvath et al.
2004/0181884 A1 9/2004 Phillipson et al.
2004/0216251 A1 11/2004 Van Der Meijden et al.
2005/0028265 A1* 2/2005 Turner ..... E04H 4/1209 4/507
2005/0108836 A1 5/2005 Rowan et al.
2005/0262652 A1 12/2005 Sumonthee
2005/0279682 A1 12/2005 Davidson et al.
2006/0042688 A1 3/2006 Sebor
2006/0059637 A1 3/2006 Fridman et al.
2006/0207041 A1 9/2006 Van Der Meyden et al.
2006/0225768 A1 10/2006 Erlich et al.
2006/0254004 A1 11/2006 Fraenkel
2007/0028405 A1 2/2007 Garti
2007/0056124 A1 3/2007 Wichmann et al.
2007/0067930 A1 3/2007 Garti
2007/0094817 A1 5/2007 Stoltz et al.
2007/0107148 A1 5/2007 Rowan et al.
2007/0251032 A1 11/2007 Pichon et al.
2007/0272274 A1 11/2007 Adam et al.
2007/0289075 A1 12/2007 Gopalan

(56) References Cited

U.S. PATENT DOCUMENTS

| | | | | |
|---|---|---|---|---|
| 2007/0289906 | A1 | 12/2007 | Gopalan | |
| 2008/0060984 | A1 | 3/2008 | Henkin et al. | |
| 2008/0087299 | A1* | 4/2008 | Erlich | E04H 4/1654 134/6 |
| 2008/0099409 | A1 | 5/2008 | Gorelik et al. | |
| 2008/0125943 | A1* | 5/2008 | Finezilber | E04H 4/1654 701/51 |
| 2008/0128343 | A1 | 6/2008 | Garti | |
| 2008/0202997 | A1 | 8/2008 | Davidson et al. | |
| 2008/0222821 | A1 | 9/2008 | Pichon | |
| 2008/0235887 | A1 | 10/2008 | Horvath et al. | |
| 2008/0236628 | A1 | 10/2008 | Horvath et al. | |
| 2008/0250580 | A1 | 10/2008 | Lavabre et al. | |
| 2008/0276388 | A1 | 11/2008 | Dodd | |
| 2008/0307589 | A1* | 12/2008 | Schneider | E04H 4/1654 15/1.7 |
| 2009/0045110 | A1 | 2/2009 | Garti | |
| 2009/0057238 | A1 | 3/2009 | Garti | |
| 2009/0232701 | A1 | 9/2009 | Porat | |
| 2009/0255069 | A1 | 10/2009 | Hui | |
| 2009/0282627 | A1 | 11/2009 | Porat | |
| 2009/0301522 | A1 | 12/2009 | Abehasera et al. | |
| 2009/0307854 | A1 | 12/2009 | Garti | |
| 2010/0043154 | A1 | 2/2010 | Kellogg | |
| 2010/0058546 | A1 | 3/2010 | Erlich | |
| 2010/0065482 | A1 | 3/2010 | Sumonthee | |
| 2010/0122422 | A1 | 5/2010 | Hui | |
| 2010/0132136 | A1 | 6/2010 | Sommer et al. | |
| 2010/0306931 | A1 | 12/2010 | Garti | |
| 2011/0000030 | A1 | 1/2011 | Pichon et al. | |
| 2011/0000031 | A1 | 1/2011 | Pichon et al. | |
| 2011/0000032 | A1 | 1/2011 | Pichon et al. | |
| 2011/0000033 | A1 | 1/2011 | Pichon et al. | |
| 2011/0000034 | A1 | 1/2011 | Pichon et al. | |
| 2011/0000035 | A1 | 1/2011 | Pichon et al. | |
| 2011/0000036 | A1 | 1/2011 | Pichon et al. | |
| 2011/0005009 | A1 | 1/2011 | Pichon et al. | |
| 2011/0016646 | A1 | 1/2011 | Pichon et al. | |
| 2011/0020139 | A1 | 1/2011 | Pichon et al. | |
| 2011/0023247 | A1 | 2/2011 | Pichon et al. | |
| 2011/0047727 | A1 | 3/2011 | Pichon et al. | |
| 2011/0067729 | A1 | 3/2011 | Erlich et al. | |
| 2011/0088181 | A1 | 4/2011 | Rief et al. | |
| 2011/0088182 | A1 | 4/2011 | Hui | |
| 2011/0154585 | A1 | 6/2011 | Mastio et al. | |
| 2011/0154586 | A1 | 6/2011 | Mastio et al. | |
| 2011/0155186 | A1 | 6/2011 | Mastio et al. | |
| 2011/0162683 | A1 | 7/2011 | Mastio et al. | |
| 2011/0197932 | A1 | 8/2011 | Mastio et al. | |
| 2011/0203060 | A1 | 8/2011 | Pichon et al. | |
| 2011/0302728 | A1 | 12/2011 | Sumonthee | |
| 2011/0314617 | A1 | 12/2011 | Van Der Meijden et al. | |
| 2012/0060307 | A1 | 3/2012 | Stoltz | |
| 2012/0074050 | A1 | 3/2012 | Rief et al. | |
| 2012/0103365 | A1 | 5/2012 | Sumonthee | |
| 2013/0152316 | A1 | 6/2013 | Rief et al. | |
| 2014/0042063 | A1 | 2/2014 | Rief | |
| 2014/0115796 | A1 | 5/2014 | Sebor et al. | |
| 2015/0020322 | A1 | 1/2015 | Rief et al. | |
| 2015/0059106 | A1 | 3/2015 | Rief et al. | |
| 2015/0076048 | A1 | 3/2015 | Rief et al. | |

FOREIGN PATENT DOCUMENTS

| | | | | |
|---|---|---|---|---|
| DE | 3110203 | A1 | 9/1982 | |
| EP | 0314259 | A2 | 5/1989 | |
| EP | 0323883 | A1 | 7/1989 | |
| EP | 0426365 | A1 | 5/1991 | |
| EP | 0468876 | A1 | 1/1992 | |
| EP | 0565226 | A1 | 10/1993 | |
| EP | 0657603 | A1 | 6/1995 | |
| EP | 0990749 | A2 | 4/2000 | |
| EP | 0990750 | A2 | 4/2000 | |
| EP | 1122382 | A1 | 8/2001 | |
| EP | 1489249 | A2 | 12/2004 | |
| EP | 1785552 | A2 | 5/2007 | |
| EP | 1849934 | A1 | 10/2007 | |
| EP | 1921229 | A2 | 5/2008 | |
| FR | 2584442 | A1 | 1/1987 | |
| FR | 2693499 | A1 | 1/1994 | |
| FR | 2729995 | A1 | 8/1996 | |
| FR | 2864129 | A1 | 6/2005 | |
| FR | 2925557 | A1 | 6/2009 | |
| FR | 2929310 | A1 | 10/2009 | |
| NO | 2008096323 | A2 | 8/2008 | |
| WO | 8700883 | A1 | 2/1987 | |
| WO | 9009498 | A1 | 8/1990 | |
| WO | 99/63185 | A1 | 12/1999 | |
| WO | 0127415 | A1 | 4/2001 | |
| WO | 01/92663 | | 12/2001 | |
| WO | 0192664 | A1 | 12/2001 | |
| WO | 03085225 | A1 | 10/2003 | |
| WO | 2004038130 | A2 | 5/2004 | |
| WO | 2005007998 | A2 | 1/2005 | |
| WO | 2005118984 | A2 | 12/2005 | |
| WO | 2006109118 | A1 | 10/2006 | |
| WO | 2006121808 | A2 | 11/2006 | |
| WO | 2007055960 | A2 | 5/2007 | |
| WO | 2011049594 | A1 | 4/2011 | |
| WO | 2014052234 | A2 | 4/2014 | |
| WO | 2015031150 | A1 | 3/2015 | |
| ZA | WO 2008102325 | A1 * | 8/2008 | E04H 4/1654 |

OTHER PUBLICATIONS

Notice of Allowance dated Dec. 13, 2012 issued in connection with U.S. Appl. No. 12/581,405 (9 pages).
Tiger Shark Owner's Manual (Mar. 2007) Exact Date Unknown.
Digital Image of Squirrel Cleaner (more than one year prior to Sep. 16, 2008) Exact Date Unknown.
Digital Image of Pool Rover Cleaner (more than one year prior to Sep. 16, 2008) Exact Date Unknown.
Digital Image of Robby Cleaner (more than one year prior to Sep. 16, 2008) (1 page) Exact Date Unknown.
Digital Image of Dolphin Cleaner (more than one year prior to Sep. 16, 2008) (1 page) Exact Date Unknown.
Digital Image of Merlin Cleaner (more than one year prior to Sep. 16, 2008) (1 page) Exact Date Unknown.
Digital Image of Aquabot Cleaner (more than one year prior to Sep. 16, 2008) (1 page) Exact Date Unknown.
Dolphin Cleaner photos (3 pages) and Dolphin Cleaner page (2 pages) (Cleaner seen at a show circa Oct. 2009) Exact Date Unknown.
Zodiac Cybemaut Manual (dated Sep. 3, 2006) (6 pages).
Polaris 9300 and Vortex 3 Cleaners (manuals dated Copyright 2010 and V3 cleaner seen at a show circa Oct. 2009) (125 pages) Exact Date Unknown.
Hexagone Cleaners (more than one year prior to Sep. 16, 2008) (8 pages).
Caratti Catalog (dated 2007) (8 pages).
Brock Catalog (dated 2005) (8 pages).
Dolphin Dx2 Hybrid Advertisement (dated 2009) (2 pages).
DX3 and DX4 Cleaners and Related Manuals (more than one year prior to Sep. 16, 2008) (17 pages) Exact Date Unknown.
Picture Sheet Showing Multiple Commercial Cleaners (more than one year prior to Sep. 16, 2008) (1 page) Exact Date Unknown.
Picture Sheet Showing Multiple Double-Wide Cleaners (more than one year prior to Sep. 16, 2008) (1 page) Exact Date Unknown.
Smartpool Nitro Cleaner Manual (more than one year prior to Sep. 16, 2008) (56 pages) Exact Date Unknown.
AquaBot Advertisement, Pool & Spa News (Oct. 2009) (2 pages).
Wave Cleaner (cleaner seen at show circa Oct./Nov. 2008) (25 pages) Exact Date Unknown.
U.S. Appl. No. 29/378,304 entitled "Pool Cleaner", filed Nov. 2, 2010 (7 pages).
Office Action dated Feb. 14, 2011 in connection with U.S. Appl. No. 12/211,720 (7 pages).
Dolphin 2×2 (more than one year prior to Sep. 16, 2008) (8 pages).

(56) References Cited

OTHER PUBLICATIONS

Hayward Tiger Shark Series Owner's Manual (16 pages) (more than one year prior to Nov. 2, 2009).
Cleaner shown at archive.org, link for Apr. 4, 2007 (2 sheets): http://web.archive.org/web/20070404093845/http:/www.mariner-3s.com/mariner_en/produkte/navigator/navigator.php.
Office Action dated Jun. 11, 2012 in connection with U.S. Appl. No. 12/938,041 (6 pages).
Office Action dated Aug. 28, 2012 in connection with U.S. Appl. No. 12/938,041 (11 pages).
Notice of Allowance dated May 4, 2009 issued in connection with U.S. Appl. No. 29/324,616 (7 pages).
Office Action dated Oct. 11, 2011 issued in connection with U.S. Appl. No. 29/378,304 (5 pages).
Notice of Allowance dated Feb. 15, 2012 issued in connection with U.S. Appl. No. 29/378,304 (4 pages).
YouTube Video of Mopper Cleaner, http://www.youtube.com/watch? v=d8NAUWH0QCk&feature=BFa &list=ULopZLfx7W4Po, e.g., attached screen shots (45 pages).
Notice of Allowance dated Jul. 6, 2012 issued in connection with U.S. Appl. No. 13/213,514 including Statement of Reasons for Allowance (7 pages).
Office Action dated Dec. 28, 2011 issued in connection with U.S. Appl. No. 13/213,514 (8 pages).
Notice of Allowance dated Aug. 27, 2012 issued in connection with U.S. Appl. No. 12/211,720 (8 pages).
Restriction Requirement dated Jul. 19, 2010 issued in connection with U.S. Appl. No. 12/211,720 (7 pages).
Office Action dated Sep. 26, 2011 issued in connection with U.S. Appl. No. 12/211,720 (7 pages).
Office Action dated Nov. 7, 2013 issued in connection with U.S. Appl. No. 13/601,436 (33 pages).
Notice of Allowance dated Oct. 15, 2013 in connection with U.S. Appl. No. 12/938,041 (7 pages).
Notice of Allowance dated Jun. 2, 2014, from U.S. Appl. No. 12/890,069 (8 pages).
Notice of Allowance dated Feb. 6, 2014, from U.S. Appl. No. 12/890,069 (8 pages).
Office Action dated Apr. 26, 2013 issued in connection with U.S. Appl. No. 12/938,041 (9 pages).
Notice of Allowance dated May 10, 2012 issued in connection with U.S. Appl. No. 12/211,720 (8 pages).
Notice of Allowance dated Feb. 2, 2012 from U.S. Appl. No. 12/211,720 (8 pages).
Office Action dated Nov. 13, 2013 issued in connection with European Patent Application Serial No. 05753885.2 (12 pages).
Office Action dated Mar. 12, 2013 issued in connection with U.S. Appl. No. 13/722,112 (12 pages).
Office Action dated Apr. 3, 2013, from U.S. Appl. No. 12/890,069 (9 pages).
Office Action dated Sep. 30, 2013, from U.S. Appl. No. 12/890,069 (8 pages).
Notice of Allowance dated Oct. 1, 2003, from U.S. Appl. No. 10/279,520 (8 pages).
Notice of Allowance dated Oct. 23, 2014 issued by the Canadian Intellectual Property Office in connection with Canadian Patent Application No. 2,774,338 (2 pages).
Office Action mailed Feb. 19, 2014, from U.S. Appl. No. 12/938,041 (13 pages).
Requisition dated Nov. 18, 2013 issued by the Canadian Intellectual Property Office in connection with Canadian Patent Application No. 2,774,338 (3 pages).
Written Opinion of the International Searching Authority dated on Feb. 6, 2015, issued in connection with International Application No. PCT/US2014/52034 (11 pages).
International Search Report of the International Searching Authority dated on Feb. 6, 2015, issued in connection with International Application No. PCT/US2014/52034 (5 pages).
Written Opinion of the International Searching Authority dated on Apr. 23, 2014, issued in connection with International Application No. PCT/US2013/61174 (5 pages).
International Search Report of the International Searching Authority dated on Apr. 23, 2014, issued in connection with International Application No. PCT/US2013/61174 (5 pages).
International Search Report of the International Searching Authority dated on Dec. 8, 2004, issued in connection with International Application No. PCT/US2003/33519 (2 pages).
International Search Report of the International Searching Authority dated on Apr. 20, 2004, issued in connection with International Application No. PCT/US2003/32503 (1 page).
Notice of Allowance dated May 5, 2004, from U.S. Appl. No. 10/296,779 (6 pages).
Office Action dated May 9, 2008, from U.S. Appl. No. 11/770,831 (8 pages).
Office Action dated Sep. 18, 2008, from U.S. Appl. No. 11/770,831 (7 pages).
Office Action dated Jan. 27, 2015, from U.S. Appl. No. 13/568,838 (18 pages).
Notice of Allowance dated Dec. 13, 2012, from U.S. Appl. No. 12/581,405 (12 pages).
International Search Report of the International Searching Authority dated on Nov. 2, 2010, issued in connection with International Application No. PCT/US2010/02359 (2 pages).
Written Opinion of the International Searching Authority dated on Nov. 2, 2010, issued in connection with International Application No. PCT/US2010/02359 (5 pages).
Notice of Allowance dated Nov. 28, 2008, from U.S. Appl. No. 11/770,831 (4 pages).
International Search Report of the International Searching Authority dated on Oct. 13, 2000, issued in connection with International Application No. PCT/US00/40167 (1 page).
International Preliminary Examination Report dated Jun. 7, 2001, issued in connection with International Application No. PCT/US2000/28144 (3 pages).
International Search Report of the International Searching Authority dated on Jan. 19, 2001, issued in connection with International Application No. PCT/US2000/28144 (1 page).
Office Action dated Jun. 29, 2004, from U.S. Appl. No. 10/296,778 (9 pages).
Notice of Allowance dated Oct. 19, 2004, from U.S. Appl. No. 10/296,778 (7 pages).
International Search Report of the International Searching Authority dated on Sep. 7, 2000, issued in connection with International Application No. PCT/US2000/14770 (1 page).
International Preliminary Examination Report dated Mar. 13, 2002, issued in connection with International Application No. PCT/US2000/14770 (7 pages).
International Search Report of the International Searching Authority dated on Oct. 3, 2000, issued in connection with International Application No. PCT/US2000/14771 (1 page).
International Preliminary Examination Report dated Aug. 19, 2002, issued in connection with International Application No. PCT/US2000/14771 (15 pages).
International Search Report of the International Searching Authority dated on Sep. 18, 2000, issued in connection with International Application No. PCT/US00/14772 (2 pages).
International Preliminary Examination Report dated Jun. 21, 2001, issued in connection with International Application No. PCT/US2000/14772 (7 pages).
Office Action dated Nov. 3, 2015, issued in connection with U.S. Appl. No. 14/337,396 (7 pages).
Office Action dated Nov. 10, 2015, issued in connection with U.S. Appl. No. 13/568,838 (21 pages).
Office Action dated Aug. 2, 2016, issued in connection with U.S. Appl. No. 14/489,259 (6 pages).
Photo of Zodiac Pool Cleaner. www.zodiacpoolsystems.com.
Zodiac Baracuda MX 8 Pool Cleaner Owner's Manual (2011) (32 pages).
Notice of Allowance dated Nov. 2, 2016 issued in connection with U.S. Appl. No. 13/627,637 (6 pages).

(56) References Cited

OTHER PUBLICATIONS

Final Office Action dated Apr. 19, 2016, issued in connection with U.S. Appl. No. 13/627,637 (9 pages).
Office Action mailed Jul. 21, 2015, issued in connection with U.S. Appl. No. 13/627,637 (9 pages).
Office Action dated Oct. 22, 2014, issued in connection with U.S. Appl. No. 13/627,637 (9 pages).

* cited by examiner

SWIMMING POOL CLEANER

RELATED APPLICATIONS

This application is a divisional of U.S. application Ser. No. 13/627,637, filed on Sep. 26, 2012, which is a continuation-in-part of U.S. application Ser. No. 12/581,405, filed on Oct. 19, 2009, now U.S. Pat. No. 8,402,585, the entire contents of both of which are incorporated herein by reference.

FIELD OF THE INVENTION

The present invention relates to swimming pool cleaners and, more particularly, to automatic swimming pool cleaners movable along an underwater pool surface for purposes of cleaning debris therefrom. Still more particularly, this invention relates to swimming pool cleaners having the flow of water pumped and/or sucked by remote pumps into and through the pool cleaners.

BACKGROUND OF THE INVENTION

Automatic swimming pool cleaners of the type that move about the underwater surfaces of a swimming pool are driven by many different kinds of systems. A variety of different pool-cleaner devices in one way or another harness the flow of water, as it is drawn or pushed through the pool cleaner by the pumping action of a remote pump for debris collection purposes.

Suction automatic pool cleaners are very successful when there is fine debris or debris that become soft in water. This fine debris is sucked up by the cleaner and deposited into a pump basket, or other debris-collection device, and the really fine debris passes into the pool filter. An example of a suction cleaner is disclosed in commonly-owned U.S. Pat. No. 6,854,148 (Rief et al.), entire contents of which are incorporated herein by reference.

Suction automatic swimming pool cleaners are used in places with much sand and slit. Although suction cleaners can take leafy debris once it has softened in the pool, large debris such and large acorns and hard leafs would plug up a suction cleaner. Suction swimming pool cleaners are also limited to the debris size due to loss of suction if the inlet and/or outlet orifices are widened to accommodate such large debris and the possibility of large debris clogging the pool pipes.

Conversely, pressure automatic swimming pool cleaners are very successful when there is large debris such as leaves and acorns, these large debris are pulled off the pool surface by virtue of a venturi effect and are placed into a debris-collection device, such as a bag, above the cleaner. An example of a pressure cleaner is disclosed in commonly-owned U.S. Pat. No. 6,782,578 (Rief et al.), entire contents of which are incorporated herein by reference. With a pressure swimming pool cleaner, the limitation is the opposite to the suction cleaner. In removing very large debris from the swimming pool, a pressure cleaner uses a collection bag or other receptacle. Regardless of how fine the walls of such receptacle are, sand and slit can pass through the them back into the pool.

The problem is that most often only one cleaner is used in a pool. Therefore, people have either a suction cleaner or a pressure cleaner. Many swimming-pool builders place a suction cleaner into a pool when it is built. This is because there is no real landscaping around the pool at the time of the cleaner installation. However, just few years later, when trees and bushes have grown up, the debris becomes overwhelming and constantly plugs the suction cleaner.

Still with the pressure cleaner, no matter how large debris is in the pool, there is always sand and slit from cement and other elements of the surrounding environment. Such fine debris will pass through the debris-collection bag back into the pool. Although some swimming pool pressure cleaners have tails that supposedly whip the debris toward the main drain, in reality such tails only bring the dirt into suspension until it falls back on the pool bottom to start the process all over again.

Attempts have been made to utilize both a suction power and a pressure flow from remote pumps by the same swimming pool cleaner apparatus. One such apparatus is disclosed in U.S. Pat. No. 5,099,535 (Chauvier et al.). The apparatus of the Chauvier et al. patent is connected to both a pressure and suction remote pumps at the same time. However, only the suction hose is used for removal of the debris from the swimming pool underwater surface. The Chauvier et al. cleaner utilizes the pressure flow only for displacement of the cleaner along the underwater pool surface such that the Chauvier et al. cleaner remains a suction cleaner at all times and retains disadvantages of suction cleaners described earlier. Therefore, to remove large or hard debris from the swimming pool, one would have to use a separate cleaner or cleaning method which accommodates successful removal of such large debris. It should further be noted that, because suction and pressure line connectors are not in the same vicinity of a swimming pool, the connection to both lines at the same, as proposed by the Chauvier et al. patent, is practically not possible.

U.S. Pat. No. 7,168,120 (Habif et al.) discloses a pressure-fed vacuum swimming pool cleaning robot. The robot of the Habif et al. patent has a structure which extends from a debris-inlet end applied to the swimming-pool underwater surface to an opposite debris-outlet end which is distal from the underwater surface. In the robot of the Habif et al. patent, the suction is always created at the debris-outlet end by either a connection of the debris-outlet end to a suction hose or by creating a venturi effect at the debris-outlet. The structure of the Habif et al. patent consistently operates as a suction cleaner which successfully removes only fine or very soft debris. This structure is not configured for removal of large and hard debris which would plug up the debris inlet as well as inner passages of the Habif et al. robot. Therefore, as with the Chauvier et al. patent, large or hard debris would have to be removed from the swimming pool by a separate cleaner different from the robot of the Habif et al. patent or by some other means designed for removal of such large debris.

Also, in some states law requires variable speed pumps. It would be beneficial to have a cleaner which consistently provides an efficient performance with pumps running at lower or higher rates and is successful in removing both fine and large debris from the swimming-pool underwater surface.

It would be desirable to have a pool cleaner allowing manufacturing to be standardized and the end user have easy accessability to the cleaner parts for maintenance.

SUMMARY OF THE INVENTION

This invention is an improved swimming pool cleaner of the type movable along an underwater pool surface to clean debris therefrom. The swimming pool cleaner of the present invention provides an important advantage of substantially strain-free and tool-free assembly.

The swimming pool cleaner includes a body having a debris inlet and a debris outlet. A segmented skirt includes a plurality of flap members each of which extends from a proximal end hinged to the body to a distal end which is configured for extending along the pool surface such that the skirt forms with the pool surface a plenum from which water and debris are drawn into the inlet. The body defines an elongate slotted cavity extending between two ends and pivotably holding the proximal ends of the flap members therewithin. The slotted cavity has an openable inlet-adjacent middle region permitting strain-free insertion of the flap-member proximal ends into the cavity for sliding therealong. The cleaner further includes a nozzle inserted into the debris inlet to control debris-laden water flow. The nozzle is positioned over the middle region of the slotted cavity retaining the flap-member proximal ends in the cavity.

The slotted cavity may be formed by first and second wall portions separated by a slot. In some embodiments, a first wall-portion configuration being continuous between the closed side ends, and a second wall-portion configuration being interrupted along the inlet-adjacent middle region permitting strain-free insertion of the flap-member proximal ends into the cavity.

In certain embodiments, the first and second wall-portion configurations each include a plurality of spaced tabs holding the flap-member proximal ends. In some of such embodiments, the second configuration is lacking the tabs along the inlet-adjacent middle region thereby opening access for sliding the flap-member proximal ends in or out of the cavity for strain-free assembly of the segmented skirt.

The cleaner body may also include a frame structure extending laterally from the debris inlet along the slotted cavity. In such versions, the tabs of the second wall-portion configuration protrude from the frame structure thereby have a reinforced configuration minimizing breakage of the tabs.

The nozzle has two opposite lateral sides and a cavity-adjacent side therebetween. In some embodiments, the nozzle includes at least one tab extending from the cavity-adjacent side over the cavity thereby closing the inlet-adjacent middle region and retaining the flap-member proximal ends within the cavity by providing continuity for the second wall-portion configuration.

In certain embodiments, the nozzle is removable from the debris inlet and is configured for engagement with the frame structure which holds the nozzle within the debris inlet. The pool cleaner may include a plurality of interchangeable nozzles each of which having a flow opening which is different in size than flow openings of the other nozzles.

Such varying in size nozzle permits easy adjustment of the inlet size to accommodate the size of debris falling into the pool. The nozzle with a larger nozzle opening will allow large debris such as leaves, plant seeds and the like to pass through while the nozzles with a small or medium flow opening may not be able to pass such debris through. Furthermore, the interchangeable nozzles of the present invention consistently provide a required efficient performance of the cleaner with variable speed pumps. The interchangeable nozzles of the present invention consistently provide a required efficient performance of the cleaner. In particular, when the pump runs at a lower rate, the nozzle with the smaller flow opening will provide the required performance. And, when the pump runs at a high rate, the nozzle with the larger flow opening will have the required performance.

In some embodiments of the present invention, the pool cleaner may be interchangeably usable as a suction cleaner for removal of fine debris such as sand and slit and as a pressure cleaner for removal of large and hard debris such as large leaves, acorns and stones. In such embodiments, the body is adapted at the debris outlet for securement of either a water-suction hose connected to a remote suction system or a debris-collection device entrapping debris and passing water therethrough back into the pool. When the cleaner is used as a pressure cleaner, the one of the nozzles which has the larger flow opening is secured with respect to the body. When the cleaner is used as a suction cleaner, the inlet size can be reduced by installing that one of the nozzles which has the smaller flow opening.

In certain embodiments, the pool cleaner includes a tool-free nozzle mounting. Such tool-free nozzle mounting includes a pair of lateral protrusions each extending from one of the lateral sides of the nozzle and a pair of frame-structure side portions extending laterally from the inlet and each engaging the corresponding lateral protrusion of the nozzle thereby retaining the nozzle within the debris inlet.

Each protrusion may have a first surface substantially orthogonal to the nozzle lateral side and a second surface sloping between the first surface and the nozzle lateral side. The orthogonal surface allows pressing on the corresponding side body portion and the sloping surface permits release of the nozzle from the inlet. Each side portion of the frame structure includes a spring-grip inwardly displaceable when pressed by the corresponding lateral protrusion of the nozzle being inserted into the debris inlet. The nozzle is being inserted beyond the spring-grip which resiliently returns into alignment with the side portion thereby locking the nozzle within the inlet.

In some embodiments, each side portion of the frame structure extends outwardly from the debris inlet thereby forming a tapered surface minimizing entrapment of the cleaner on step-like pool structures.

In certain embodiments, the pool cleaner also includes a tool-free wheel-mounting assembly which supports at least one pair of wheels moving the cleaner along the pool surface. The tool-free wheel-mounting assembly includes each of the wheels having a ball bearing rotatably holding such wheel on a non-rotating shaft extending laterally from the respective side of the cleaner body, each ball-bearing having an interior configuration matching an exterior configuration of the shaft in non-rotating engagement therewith. Each shaft may have a polygonal exterior with each bearing having a polygonal interior matching the shaft exterior in non-rotating engagement therewith. The ball bearing may be a double-race bearing in non-rotating engagement with the respective wheel.

In some versions, each shaft has a hollow interior with an inwardly-facing shoulder therewithin. In such versions, the tool-free wheel-mounting assembly includes a removable clip inserted into the shaft interior and in a locking engagement with the shoulder. The clip has at least two fingers which extend from an exterior head and terminate with a hook-end within the shaft interior. The fingers are being pressed together upon insertion into the shaft and spreading outwardly into the locking engagement with the shoulder thereby securely holding the wheel on the shaft.

Another aspect of the present invention is a method for tool-free assembly of the swimming pool cleaner. In this method, the nozzle is installed by pressing the spring-grip with the nozzle into the inlet until the nozzle is beyond the spring-grip which resiliently returns to its original orientation thereby locking the nozzle within the inlet.

The inventive method also includes the step of hingedly attaching the segmented skirt to the body. The skirt is attached to the body in a stain-free fashion. In particular, prior to installing the nozzle, a proximal end (also referred to as an attaching end) of each flap member is freely places into the open inlet-adjacent middle region of the slotted cavity. The flap members are secured within the cavity by the step of installing the nozzle being positioned over and closing the inlet-adjacent middle region.

The tool-free assembly method also may further include a step of tool-free mounting of the wheels by sliding the ball-bearing polygonal interior of each wheel over the corresponding matching polygonal shaft exterior for a non-rotating engagement therebetween. In such embodiments, the ball bearing provides wheel rotation. The wheel is securely held on the shaft by the removable clip inserted into the shaft interior and into a locking engagement with the shoulder.

DETAILED DESCRIPTION OF PREFERRED EMBODIMENTS

FIGS. 1-21 illustrate exemplary embodiments of aspects of the present invention for an improved swimming pool cleaner 100 of the type movable along an underwater pool surface 2 to clean debris therefrom.

Figure 1:
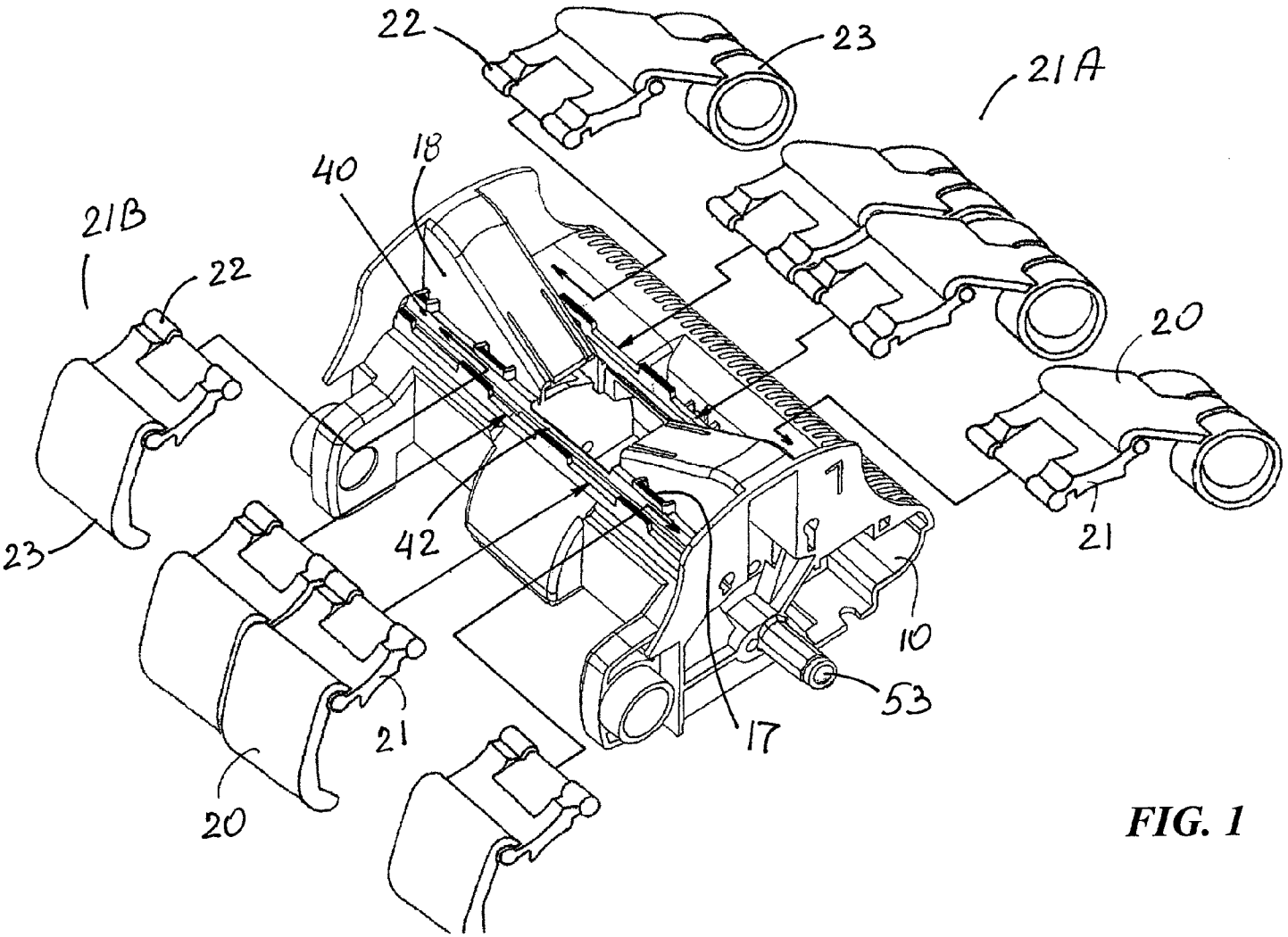
FIG. 1 is an exploded bottom perspective view of a swimming pool cleaner according to the present invention.
Figure 2:
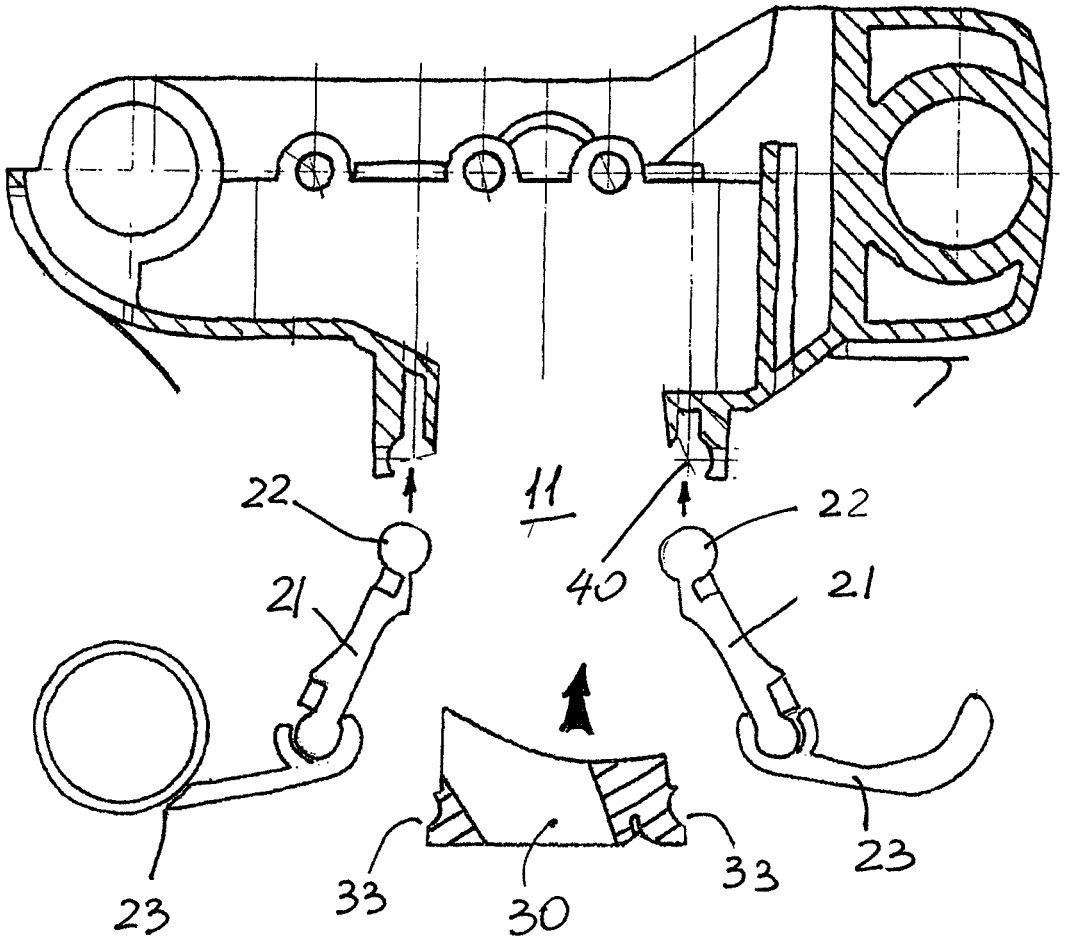
FIG. 2 is an exploded cross-sectional side view of the swimming pool of FIG. 1.
Figure 3:
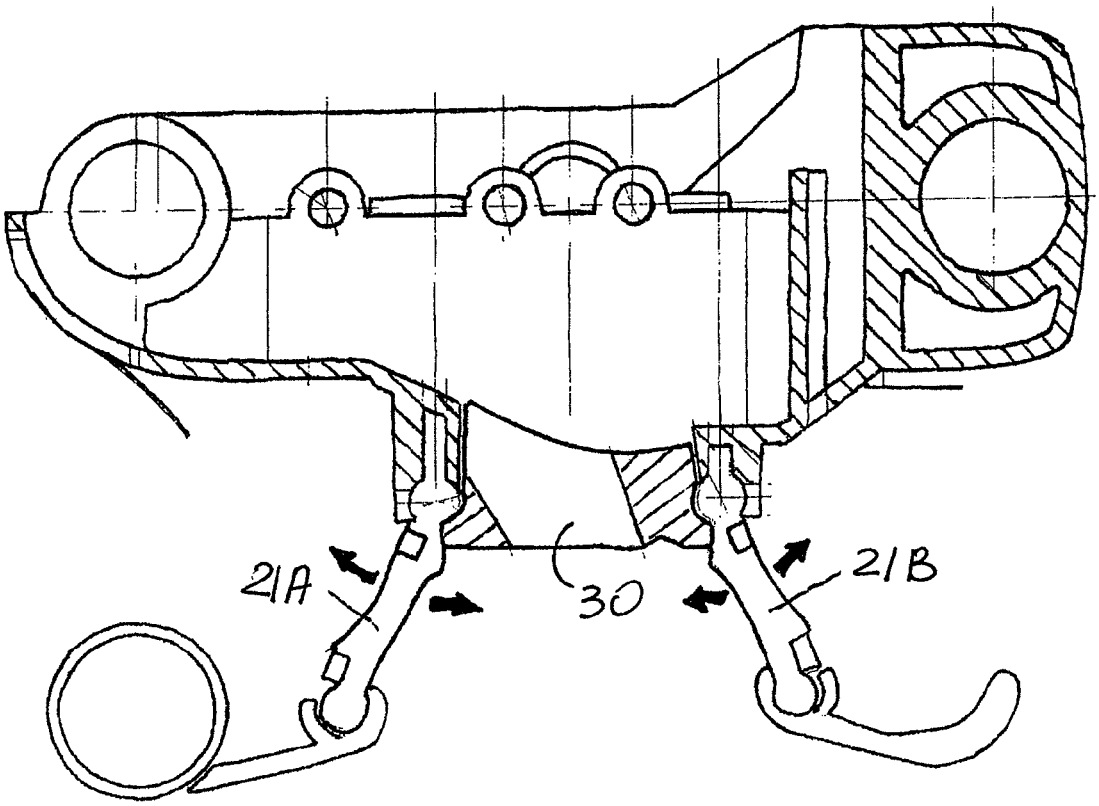
FIG. 3 is a cross-sectional side view of the assembled swimming pool cleaner of FIG. 1.
Figure 18:
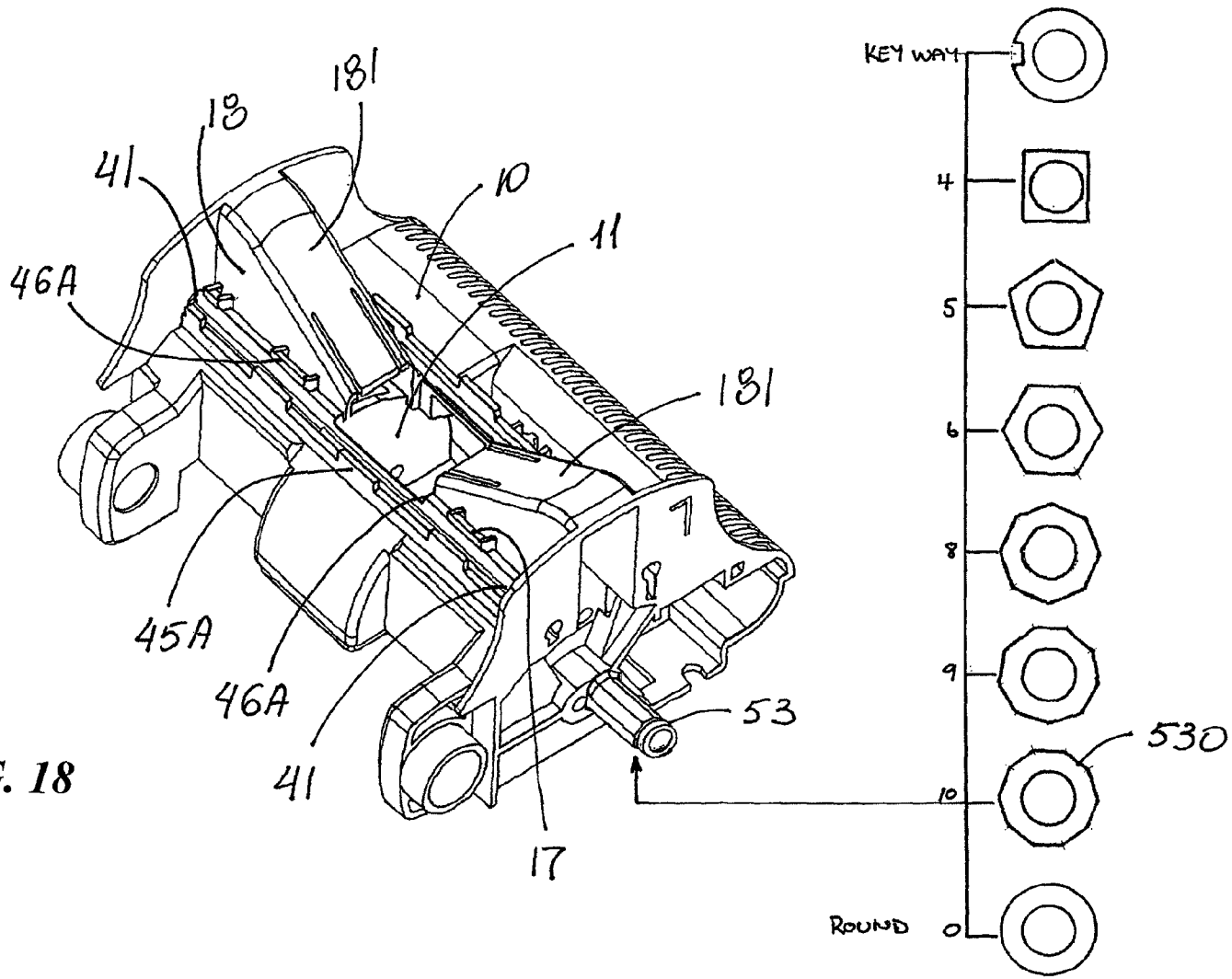
FIG. 18 is a bottom perspective view of a swimming pool cleaner showing alternative shapes for a matching shaft exterior and ball-bearing interior for tool-free wheel mounting according to the present invention.
Figure 19:
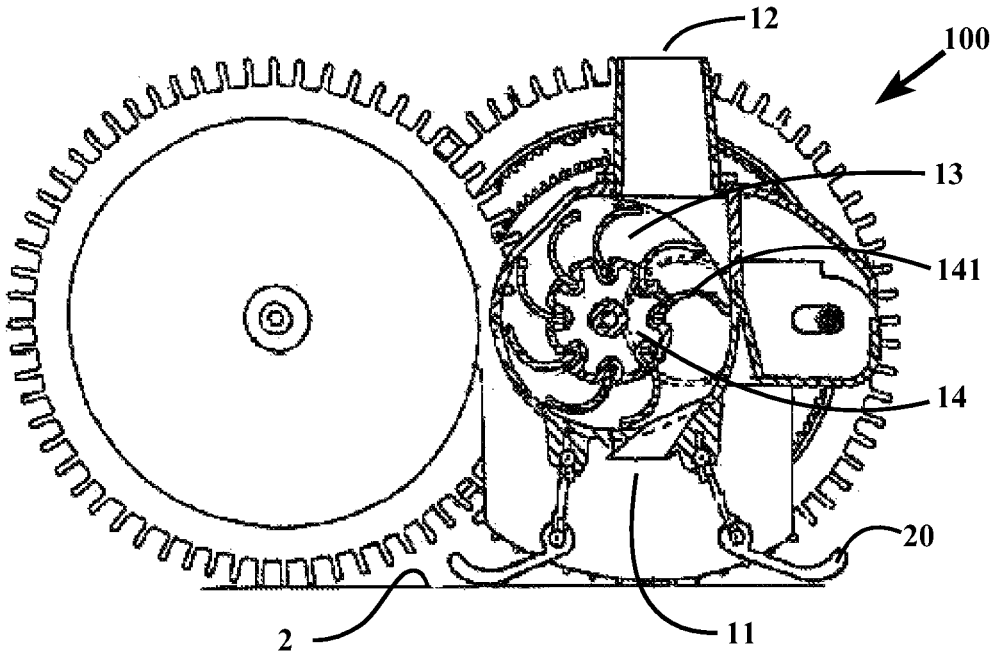
FIG. 19 is a side cross-sectional view of one example of a suction cleaner.

FIGS. 1 and 18-20 illustrate swimming pool cleaner 100 including a body 10 having a debris inlet 11 and a debris outlet 12. As best seen in FIGS. 1-3, a segmented skirt 20 includes a plurality of flap members 21 each of which extends from a proximal (or mounting) end 22 hinged to body 10 to a distal end 23 which is configured for extending along pool surface 2 such that skirt 20 forms with pool surface 2 a plenum from which water and debris are drawn into inlet 11, as best illustrated in FIG. 19. FIGS. 1-3, 5 and 18 show body 10 defining an elongate slotted cavity 40 extending between two ends 41 and pivotably holding proximal ends 22 of flap members 21 therewithin.

Prior to this invention, proximal ends of the skirt were clipped into the slotted cavity. Such clipping created stress on the cavity walls and skirt retaining structures which would later easily break later after the exposure to pool chemicals and deterioration of the plastic materials of which the body is made.

FIGS. 1-3 show that inventive cleaner 100 has slotted cavity 40 with an openable inlet-adjacent middle region 42 permitting strain-free insertion of flap-member proximal ends 22 into cavity 40. FIG. 1 shows skirt 20 including forward and rear sets of flap members 21A and 21B. Each set includes a pair of end flap members 21 which are inserted into middle region 42 for sliding along cavity 40 toward their installed positions at a respective end 41. Each set is also shown to include a pair of middle flap members 21 which are inserted into middle region 42 in their installed position adjacent inlet 11. FIGS. 1-3 best illustrate proximal ends 23 of flap members 21 having a substantially cylindrical shape and cavity 40 being configured to substantially conform such cylindrical shape (see FIG. 5) with a slot 44 being configured and dimensioned to permit pivoting of flap members 21, as seen in FIG. 3.

Figure 4:
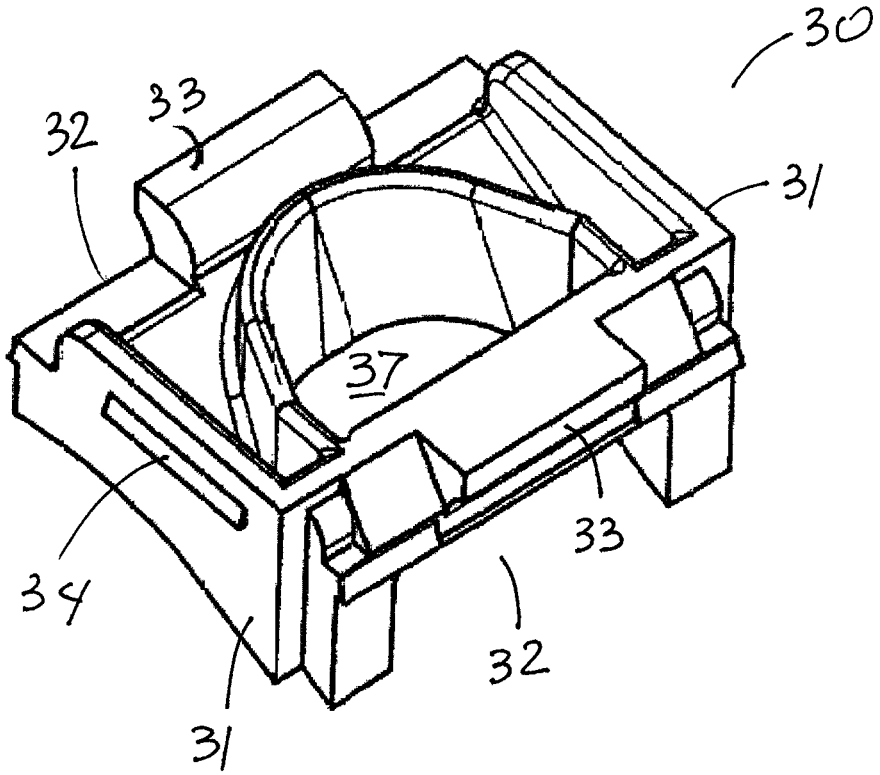
FIG. 4 is a perspective view of a nozzle for the swimming pool cleaner according to the present invention.

FIGS. 2-4 show a nozzle 30 inserted into debris inlet 11 to control debris-laden water flow. As best seen in FIG. 3, nozzle 30 is positioned over middle region 42 of slotted cavity 40 thus retaining flap-member proximal ends 22 in cavity 40. Nozzle 30 is installed over proximal ends 21 of the middle flap members 41.

Figure 5:
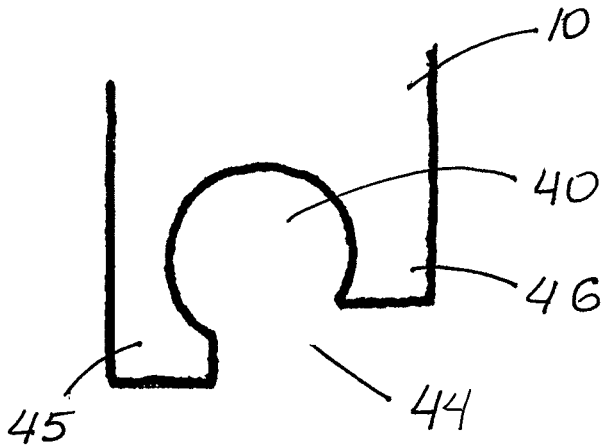
FIG. 5 is an enlarged fragmentary cross-sectional view showing a configuration of a slotted cavity seen in FIG. 1.

FIGS. 2 and 5 best show slotted cavity 40 formed by first and second wall portions 45 and 46 separated by slot 44. FIGS. 1 and 18 show a first wall-portion configuration 45A continuously between ends 41 which are shown as closed side ends. A second wall-portion configuration 46A is shown as being interrupted along inlet-adjacent middle region 42 to permit strain-free insertion of flap-member proximal ends 22 into cavity 40. Such strain-free and tool-less skirt assembly also permits for easy replacement of worn flap members by the end user without any tools.

FIGS. 1 and 18 further show first and second wall-portion configurations 45A and 46A each including a plurality of spaced tabs 17 holding flap-member proximal ends 22. Second configuration 46A lacks tabs 17 along inlet-adjacent middle region 42 thereby opening access for strain-free insertion or removal of flap-member proximal ends 22 in or out of cavity 40 for strain-free assembly of segmented skirt 20.

FIGS. 1, 6-11 and 18 show cleaner body 10 also including a frame structure 18 extending laterally from debris inlet 11 along slotted cavity 40. It is further seen in FIGS. 1 and 18 that tabs 17 of second wall-portion configuration 46A protrude from frame structure 18 thereby being reinforced to minimize breakage of tabs 17.

FIGS. 1, 6, 8, 10 and 18 also show frame structure 18 extending laterally and outwardly from debris inlet 11 thereby forming a pair of tapered surfaces 181 minimizing entrapment of cleaner 100 on step-like pool structures. Such angled surfaces give the cleaner an ability to slide off any step or pool ledge, thus minimizing stopping of the cleaner on such pool structures.

FIG. 4 shows nozzle 30 having two opposite lateral sides 31 and two opposite cavity-adjacent sides 32 therebetween. Nozzle 30 includes tabs 33 extending from each of cavity-adjacent sides 32 over cavity 40 thereby closing inlet-adjacent middle region 42 and retaining flap-member proximal ends 22 within cavity 40 by providing continuity for second wall-portion configuration 46A.

FIGS. 2, 3 and 6-11 show nozzle 30 being removable from debris inlet 11 and configured for engagement with frame structure 18 which holds nozzle within debris inlet 11.

Figure 20:
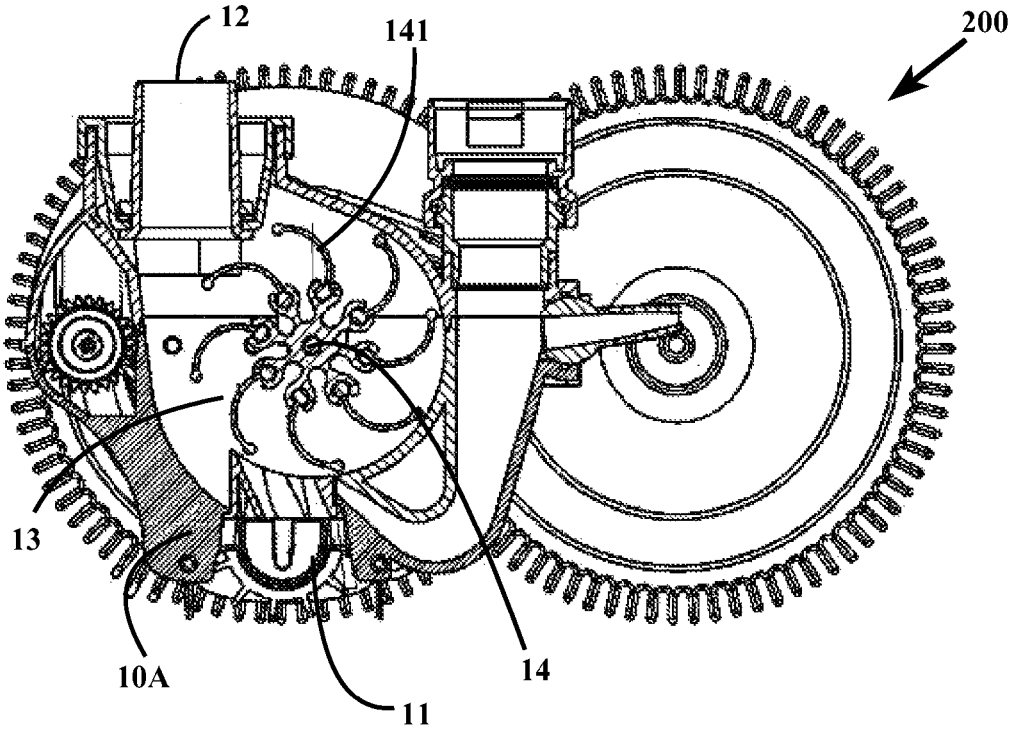
FIG. 20 is a side cross-sectional view of an example of a pool cleaner which can be interchangeably used as a suction cleaner and a pressure cleaner.

FIGS. 19 and 20 show body 10 defining a water-flow chamber 13 through which water passes from debris inlet 11 to debris outlet 12. Illustrated swimming pool cleaner 100 is of the type motivated by water flow through it to move cleaner 100 along underwater pool surface 2 to be cleaned. As seen in FIGS. 19 and 20, turbine 14 is rotatably mounted within water-flow chamber 13 and has turbine vanes 141 which are moved by the water flow to rotate turbine 14.

The improved cleaner of this invention provides excellent power and drive particularly when the turbine is in the highly preferred forms which are the subject of co-owned U.S. Pat. Nos. 6,292,970 and 6,854,184.

The removability of nozzle 30 allows easy access to chamber 13 through inlet 11 such that the end user may remove any debris entrapped within turbine 14 without any need for opening an upper housing of the cleaner. Furthermore, in cleaner 100 with removable nozzle 30, body 10 can be molded as one standard configuration without the need for sonic welding of threaded inserts onto body 10. This also positively affects storage of body 10 which is a lower body piece for cleaner like cleaner 100. Prior to this invention, in cleaners with a non-removable nozzle and smaller flow opening, the lower body had to have a separate molding process.

As illustrated in FIGS. 6-11 nozzle 30 is installed and is removable without any tools. Pool cleaner 100 includes a tool-free nozzle mounting which includes a pair of lateral protrusions 34 each extending from one of lateral sides 31 of nozzle 30 and a pair of frame-structure side portions 19 extending laterally from inlet 11 and each engaging the corresponding lateral protrusion 34 of nozzle 30 thereby retaining nozzle 30 within debris inlet 11. Each side portion 19 of frame structure 18 includes a spring-grip 16 inwardly displaceable when pressed by the corresponding lateral protrusion 34 of nozzle 30 being inserted into debris inlet 11.

Figures 6, 7:
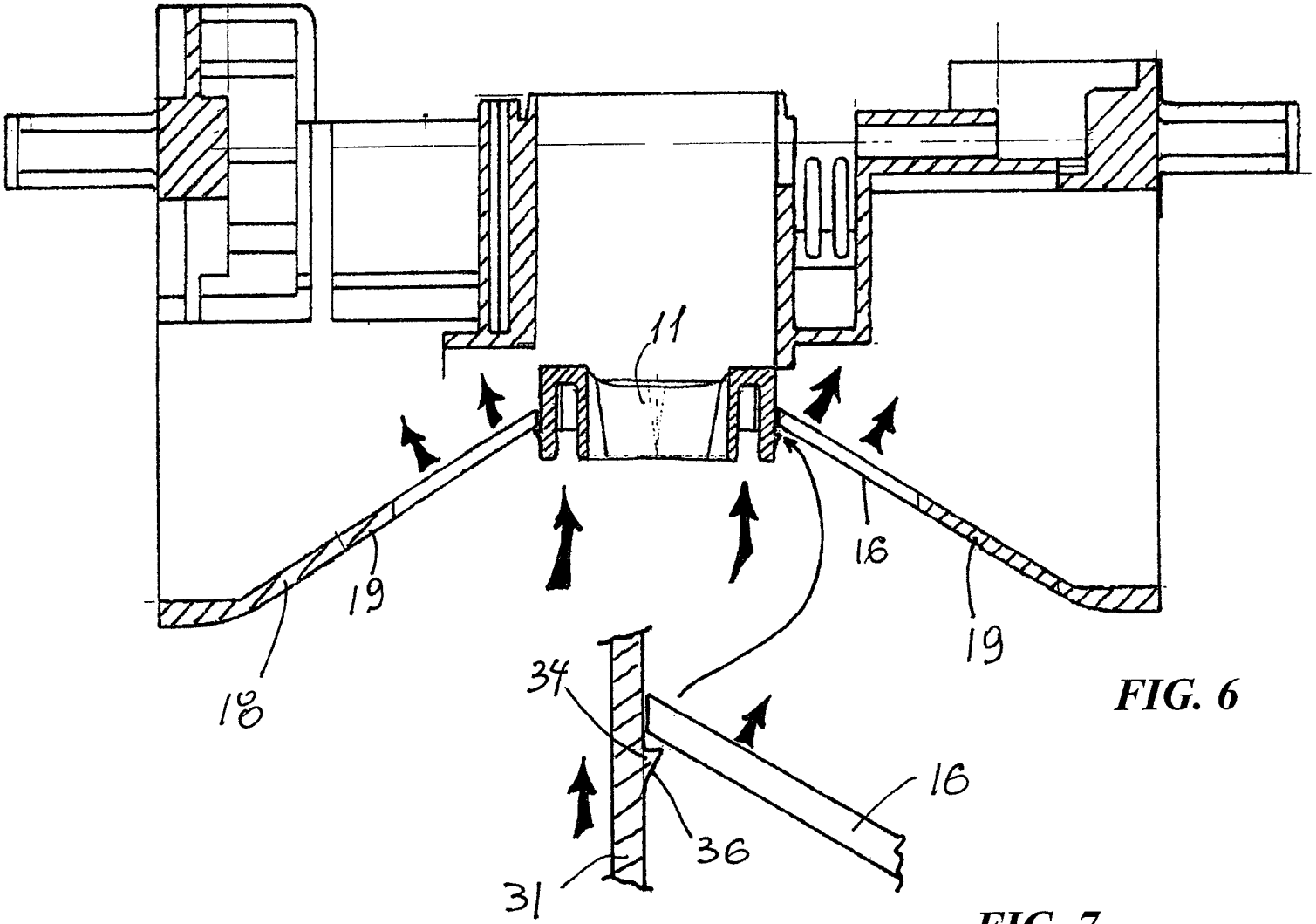
FIG. 6 is a lateral cross-sectional view showing the step of installing the nozzle by pressing the spring-grip with the nozzle.
FIG. 7 is an enlarged fragmentary cross-section view showing interaction between the nozzle lateral side and the spring-grip as seen in FIG. 6.
Figures 8, 9:
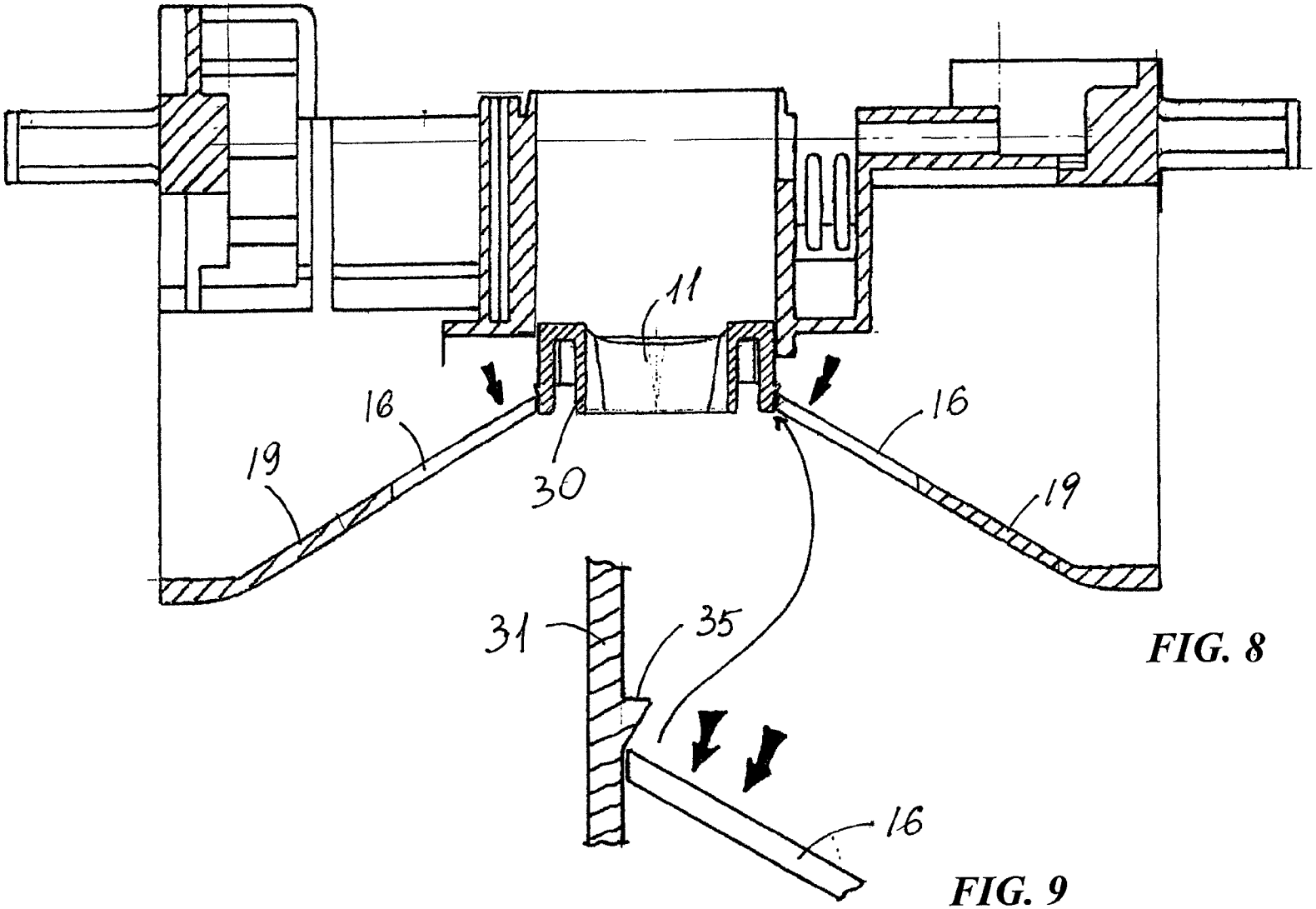
FIG. 8 is a lateral cross-sectional view showing the step of installing the nozzle by pressing the nozzle into the inlet beyond the spring-grip.
FIG. 9 is an enlarged fragmentary cross-section view showing interaction between the nozzle lateral side and the spring-grip as seen in FIG. 8.
Figures 10, 11:
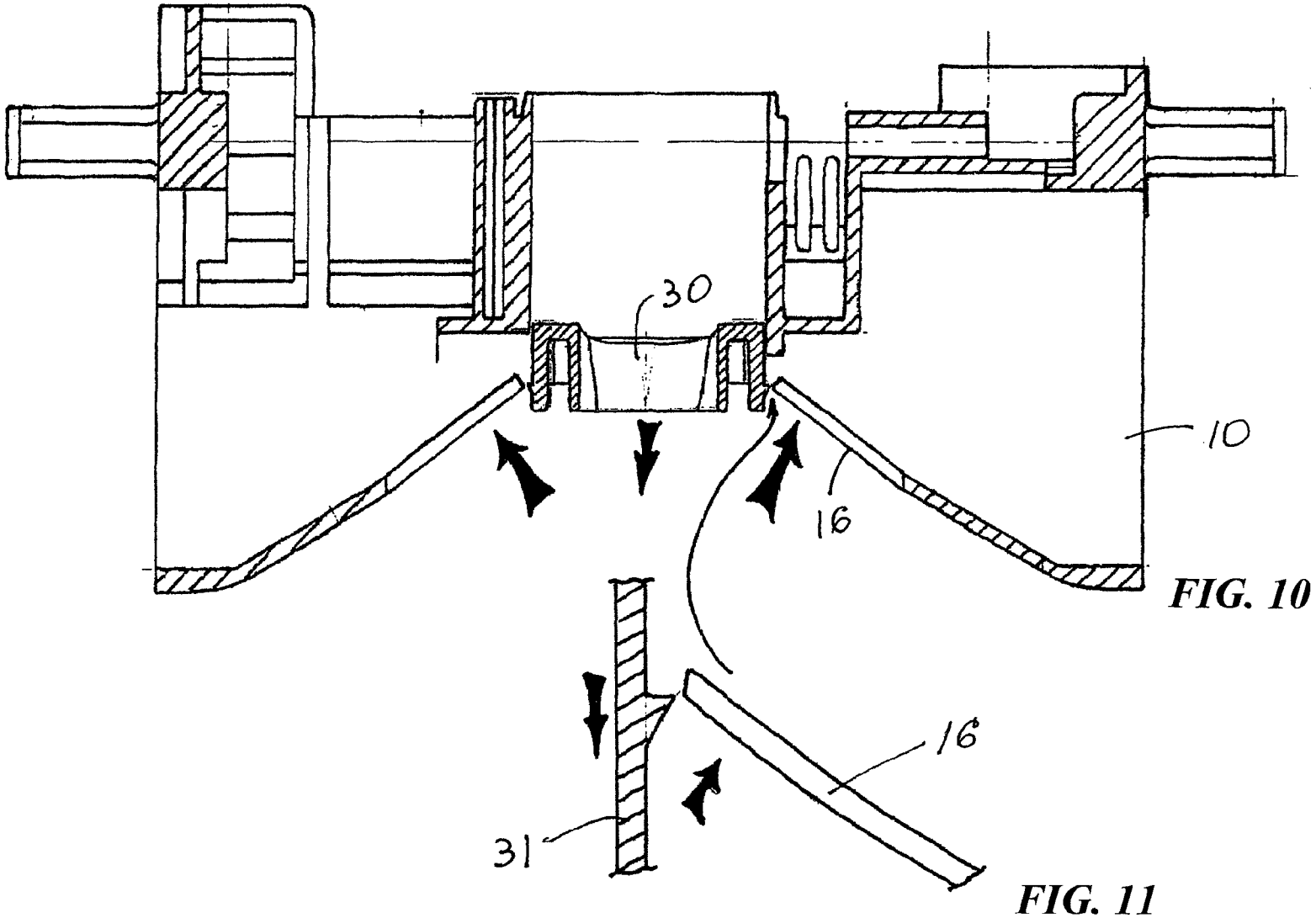
FIG. 10 is a lateral cross-sectional view showing the step of removing the nozzle from the inlet by inward displacement of the spring-grip thereby releasing the nozzle.
FIG. 11 is an enlarged fragmentary cross-section view showing interaction between the nozzle lateral side and the spring-grip as seen in FIG. 10.

As best seen in FIGS. 7, 9 and 11, each protrusion 34 has a first surface 35 substantially orthogonal to nozzle lateral side 31 and a second surface 36 sloping between first surface 35 and nozzle lateral side 31. FIGS. 6-9 illustrate installation of nozzle 30 by pressing orthogonal surface 35 of nozzle 30 on the corresponding spring-grip 16 (see FIGS. 6 and 7) to pass nozzle 30 toward inlet 11 and beyond spring-grip 16 which resiliently returns to its original orientation in alignment with side portion 19 thereby locking nozzle 30 within inlet 11 (see FIGS. 8 and 9). FIGS. 10 and 11 illustrate how sloping surface 36 permits release of nozzle 30 from inlet 11 by pressing each side portion 19 inwardly beyond orthogonal surface 34 of nozzle 30 which is then free for removal from inlet 11.

Figure 12:
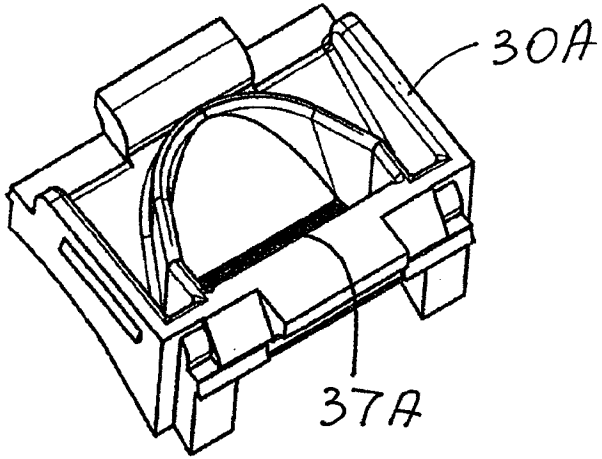
FIG. 12 is a perspective view of the nozzle with a small flow opening for the swimming pool cleaner according to the present invention.
Figure 13:
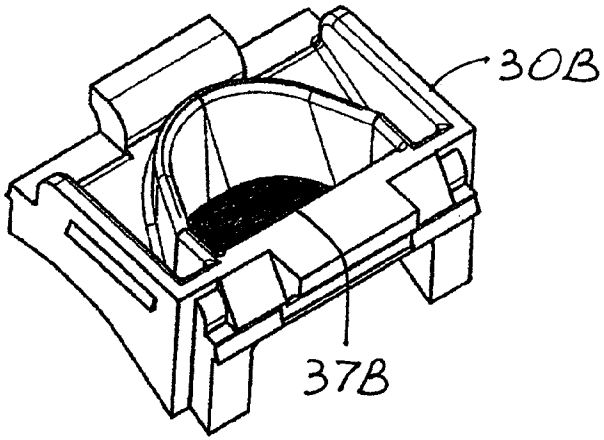
FIG. 13 is a perspective view of the nozzle with a medium flow opening for the swimming pool cleaner according to the present invention.
Figure 14:
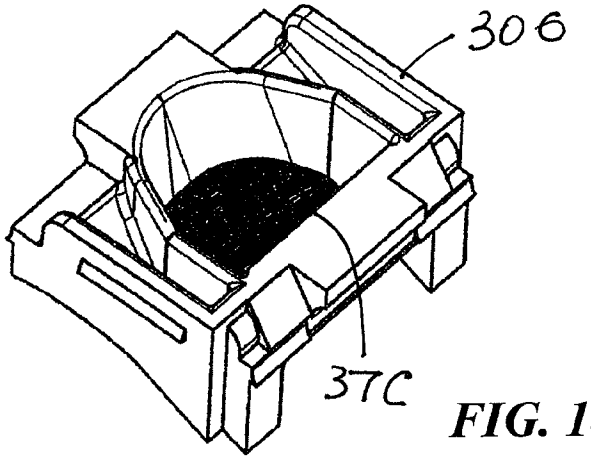
FIG. 14 is a perspective view of the nozzle with a large flow opening for the swimming pool cleaner according to the present invention.

Cleaner 100 has a plurality of nozzles 30A, 30B and 30C for being interchangeably used with cleaner 100. FIGS. 12-14 show each of nozzles 30A, 30B and 30C having a flow opening 37A, 37B and 37C which is different in size than flow openings 37 of other nozzles 30. Such varying in size nozzle permits easy adjustment of the inlet size to accommodate the size of debris falling into the pool. Nozzle 30C with larger flow opening 37C will allow large debris such as leaves, plant seeds and the like to pass through while nozzles 30A and 30B with small and medium flow openings 37A and 37B may not be able to pass such debris through. Interchangeable nozzles 30 also accommodate variable speed pumps such that when the pump runs at a lower rate, nozzle 30A with smaller flow opening 37A will provide the required performance. And, when the pump runs at medium or high rate, nozzles 30B and 30C with medium and larger flow openings 37B and 37C will have the required performance.

FIG. 20 illustrates pool cleaner 200 which may be interchangeably usable as a suction cleaner and as a pressure cleaner. FIG. 20 shows body 10A adapted at debris outlet 12 for securement of either a water-suction hose connected to a remote suction system or a debris-collection device entrapping debris and passing water therethrough back into the pool. When cleaner 200 is used as a pressure cleaner, nozzle 30C which has larger flow opening 37C is secured with respect to body 10A. When cleaner 200 is used as a suction cleaner, the inlet size can be reduced by installing nozzle 30A which has the smaller flow opening 37A.

Figure 15:
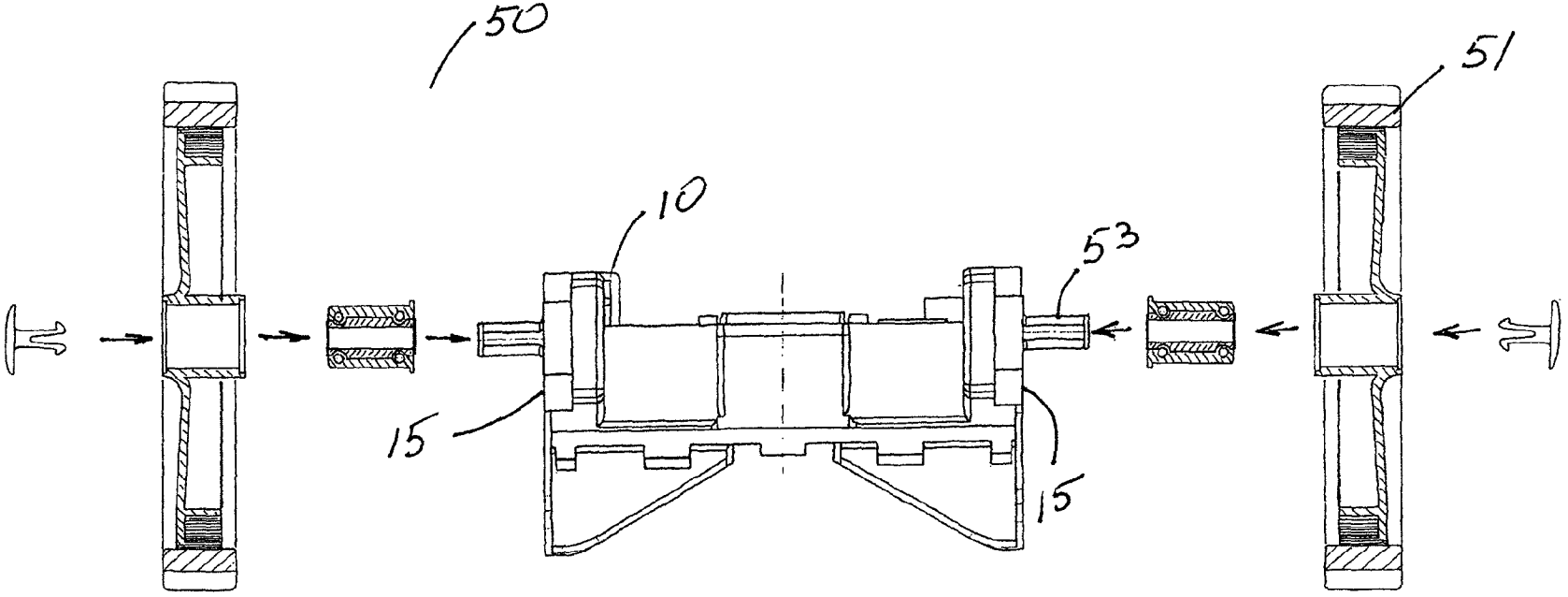
FIG. 15 is a lateral exploded cross-sectional view showing the step of tool-free wheel mounting.
Figure 16:
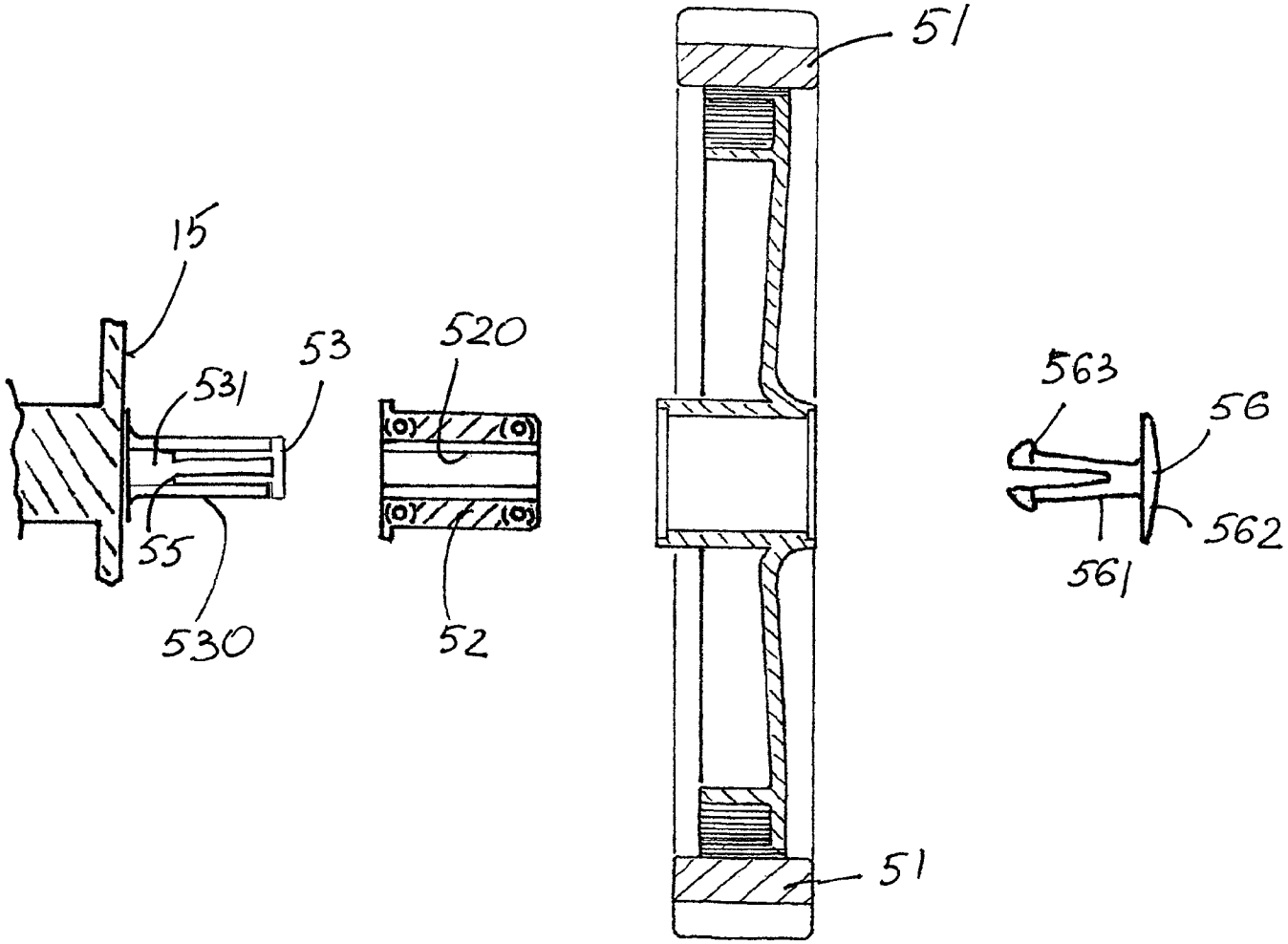
FIG. 16 is an enlarged fragmentary exploded lateral cross-sectional view showing the step of tool-free wheel mounting of one of the wheels as seen in FIG. 15.
Figure 17:
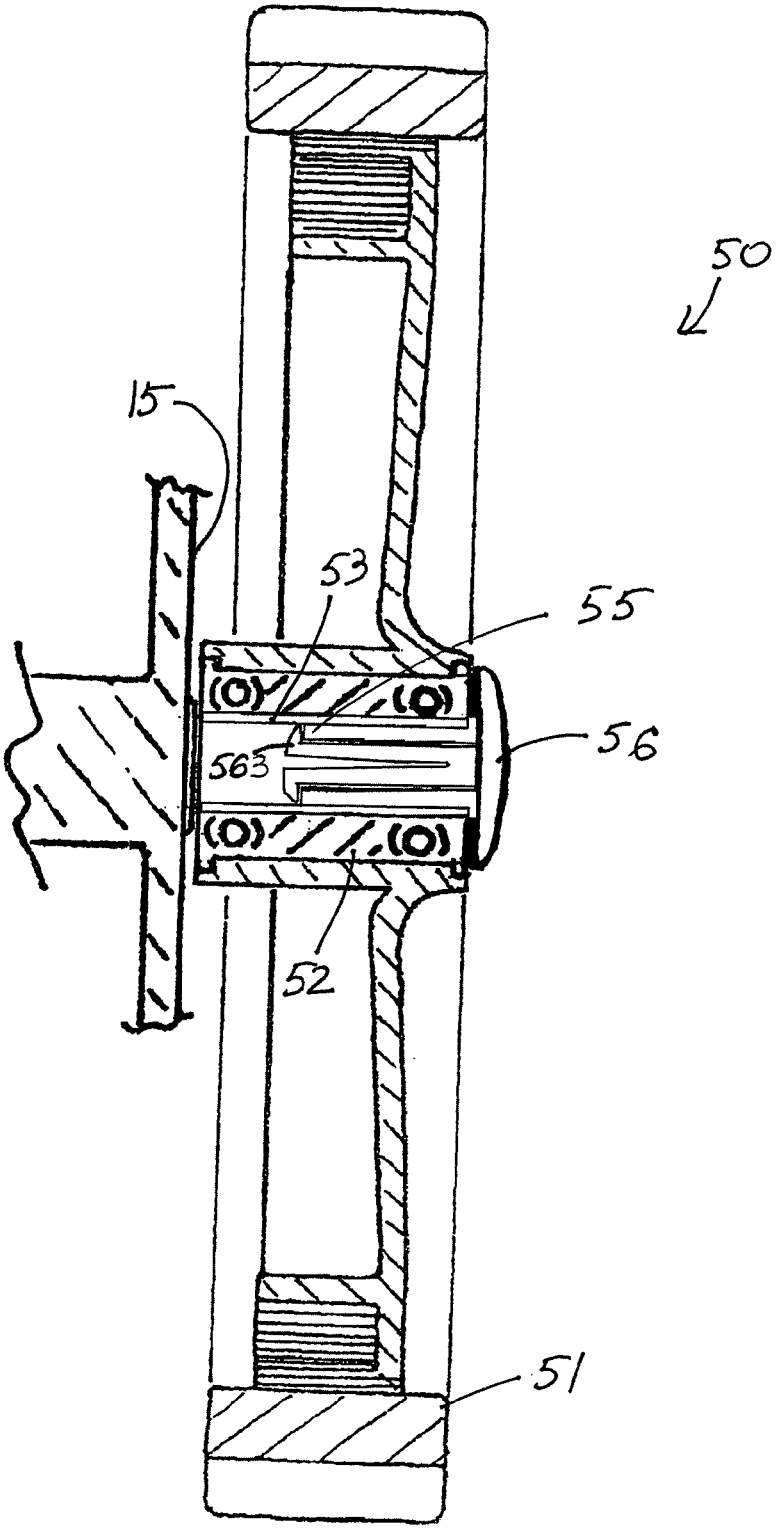
FIG. 17 is a lateral fragmentary cross-sectional view showing the tool-free mounting of one of the wheels.

FIGS. 15-18 illustrate a tool-free wheel-mounting assembly 50. FIGS. 18-20 show a one pair of wheels 51 for moving cleaner 100 along pool surface 2. FIGS. 15-17 illustrate tool-free wheel-mounting assembly 50 as including a ball bearing 52 for each of wheels 51 and rotatably holding such wheel 51 on a non-rotating shaft 53 extending laterally from the respective side 15 of cleaner body 10. It is seen in FIGS. 16 and 17 that each ball-bearing 52 has an interior configuration 520 matching an exterior configuration 530 of shaft 53 such that ball bearing 52 and shaft 53 are in non-rotating engagement with each other. Each shaft exterior 530 and each bearing interior 520 are shown in FIG. 18 as having a polygonal configuration. FIG. 18 also illustrates other possible shaft exterior and bearing-interior configurations, including polygons with 4, 5, 6, 7, 9 and 10 sides. One such configuration may be round with a protrusion on one of the shaft exterior 530 and the bearing interior 520 and a conforming cavity on the other one of the shaft exterior 530 and the bearing interior 520 such that shaft 53 and bearing 52 are locked in non-rotating engagement therebetween. When this configuration is round, ball bearing 52 is closely fitted over shaft 53 to prevent rotation therebetween.

Prior to this invention, shoulder bolts had to be used for securing wheels to the cleaner body. The shoulder bolts have shown to wear fairly quickly resulting in wheel hubs getting an undesirable lateral movement. Such lateral movement negatively affects a sonic molding of wheel-supporting parts to the body such that the sonic molding is separated and the wheel-supporting parts being removed out of the body.

FIGS. 15-17 show ball bearing 52 as a double-race bearing which is in a non-rotating engagement with respective wheel 51. The bearings have shown superior rotating properties and through extended tests exhibited wear and tear as well as their overall performance significantly better than prior wheel-assembly configurations. The tool-less wheel assembly which provided for easy disassembly gives the end used an ability to easily replace bearings in the wheel hubs without the need for any special tools.

FIGS. 16 and 17 show each shaft having a hollow interior 531 with an inwardly-facing shoulder 55 inside shaft 53. Tool-free wheel-mounting assembly 50 also includes a removable clip 53 which is inserted into shaft interior 531 into a locking engagement with shoulder 55, as seen in FIG. 17. FIGS. 16 and 17 further show clip 56 having at least two fingers 561 which extend from an exterior head 562 and terminate with a hook-end 563 within shaft interior 531. Fingers 561 arc being pressed together upon insertion into shaft 53 and then spread out inside shaft 53 into the locking engagement with shoulder 55 thereby securely holding wheel 51 on shaft 53, as illustrated in FIG. 17.

While the principles of the invention have been shown and described in connection with specific embodiments, it is to be understood that such embodiments are by way of example and are not limiting.

The invention claimed is:

1. A method for tool-free assembly of a swimming pool cleaner movable along an underwater pool surface to clean debris therefrom, the method comprising:

providing:

a body having a debris inlet and a debris outlet, the body forming an inwardly-displaceable spring-grip extending laterally from the inlet; and a removable nozzle for controlling debris-laden water flow into the inlet; and installing the nozzle by pressing the spring-grip with the nozzle into the inlet until the nozzle is beyond the spring-grip which resiliently returns to its original orientation thereby locking the nozzle within the inlet.

2. The method of claim 1 wherein:

the nozzle has a pair of lateral protrusions each extending from one of lateral sides of the nozzle; and the spring grip is formed by a pair of side body portions extending laterally from the inlet and each engaging the corresponding lateral protrusion of the nozzle thereby retaining the nozzle within the debris inlet.

3. The method of claim 2 wherein:

the body defines an elongate slotted cavity extending between two ends and having an open inlet-adjacent middle region;

the providing step further includes a segmented skirt having a plurality of flap members each of which extends from an attaching end to a free end which is configured for extending along the pool surface such that the skirt forms with the pool surface a plenum from which water and debris are drawn into the inlet.

4. The method of claim 3 further including the step of hingedly attaching the segmented skirt to the body by:

prior to installing the nozzle, freely placing the attaching end of each flap member into the open inlet-adjacent middle region of the slotted cavity; and securing the flap members within the cavity by the step of installing the nozzle being positioned over and closing the inlet-adjacent middle region.

5. The method of claim 1 wherein:

the cleaner body has two lateral sides each including a non-rotating shaft extending laterally therefrom, each shaft having a polygonal exterior;

the providing step further includes at least one pair of wheels for moving the cleaner along the pool surface, each wheel having a ball bearing with a polygonal interior matching the shaft exterior; and a step of tool-free mounting the wheels for rotation with respect to the body includes sliding the ball-bearing polygonal interior of each wheel over the corresponding matching polygonal shaft exterior for a non-rotating engagement therebetween, the ball bearing providing wheel rotation.

6. The method of claim 5 wherein:

each shaft has a hollow interior with an inwardly-facing shoulder therewithin; and the step of tool-free wheel-mounting includes the step of inserting a removable clip into the shaft interior and into a locking engagement with the shoulder, the clip having at least two fingers which extend from an exterior head and terminate with a hook-end within the shaft interior, the fingers being pressed together upon insertion into the shaft and spreading outwardly into the locking engagement with the shoulder thereby securely holding the wheel on the shaft.

* * * * *